US009016828B2

(12) United States Patent
Yatsunami

(10) Patent No.: US 9,016,828 B2
(45) Date of Patent: Apr. 28, 2015

(54) LIQUID EJECTING APPARATUS AND METHOD FOR DETECTING MEDIUM EDGE POSITION IN LIQUID EJECTING APPARATUS

(71) Applicant: Seiko Epson Corporation, Tokyo (JP)

(72) Inventor: Tetsuji Yatsunami, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 35 days.

(21) Appl. No.: 13/853,543

(22) Filed: Mar. 29, 2013

(65) Prior Publication Data

US 2013/0265361 A1 Oct. 10, 2013

(30) Foreign Application Priority Data

Apr. 4, 2012 (JP) ..... 2012-085637

(51) Int. Cl.
*B41J 29/393* (2006.01)
*B41J 11/00* (2006.01)

(52) U.S. Cl.
CPC ..... *B41J 11/0095* (2013.01); *B41J 29/393* (2013.01)

(58) Field of Classification Search
None
See application file for complete search history.

(56) References Cited

U.S. PATENT DOCUMENTS 6,371,592 B1 * 4/2002 Otsuka et al. ..... 347/19

FOREIGN PATENT DOCUMENTS

| | | | |
|---|---|---|---|
| JP | 2002-127521 | A | 5/2002 |
| JP | 2003-260829 | A | 9/2003 |
| JP | 2005-329556 | A | 12/2005 |
| JP | 2010-194748 | A | 9/2010 |

* cited by examiner

*Primary Examiner* — Lisa M Solomon
(74) *Attorney, Agent, or Firm* — Global IP Counselors, LLP

(57) ABSTRACT

To provide a liquid ejecting apparatus and a method for detecting a medium edge position in a liquid ejecting apparatus whereby a decline in the accuracy of detecting an edge position of a medium caused by fouling of an optical sensor can be minimized, a reference reflecting surface, used in order to acquire a sensitivity determination value for determining the timing of switching the sensitivity of a sheet width sensor provided to a carriage, is irradiated with light and the output voltage of a light-receiving unit receiving the reflected light thereof is acquired; the output voltage is subtract from a power source voltage to measure a reference surface voltage.

5 Claims, 14 Drawing Sheets

LOW DEGREE OF FOULING (ΔV1>b)

HIGH DEGREE OF FOULING (ΔV2<b)

SENSITIVITY SWITCHED

| Ratio Vs/Vs0 | Correction Amount dx (mm) | |
|---|---|---|
| | Normal Paper | Glossy Paper |
| 0.5 | 3.5 | x. x |
| 0.6 | 3.3 | x. x |
| 0.7 | 3.1 | x. x |
| 0.8 | 2.9 | x. x |
| 0.9 | 2.8 | x. x |
| 1.0 | 2.7 | x. x |
| 1.1 | 2.6 | x. x |
| 1.2 | 2.5 | x. x |
| 1.3 | 2.4 | x. x |
| 1.4 | 2.3 | x. x |
| 1.5 | 2.2 | x. x |

TD

LIQUID EJECTING APPARATUS AND METHOD FOR DETECTING MEDIUM EDGE POSITION IN LIQUID EJECTING APPARATUS

CROSS-REFERENCE TO RELATED APPLICATIONS

This application claims priority to Japanese Patent Application No. 2012-085637 filed on Apr. 4, 2012. The entire disclosure of Japanese Patent Application No. 2012-085637 is hereby incorporated herein by reference.

BACKGROUND

1. Technical Field

The present invention relates to: a liquid ejecting apparatus provided with a liquid ejecting head, wherein the liquid ejecting apparatus is provided with a function for detecting an edge position of a medium, such as a sheet of paper, using a light reflection optical sensor provided thereto; and to a method for detecting a medium edge position in a liquid ejecting apparatus.

2. Background Technology

An ink jet printer has been well-known as one example of this kind of liquid ejecting apparatus. Provided to the printer is a carriage which moves in a movement direction (main scanning direction) that intersects with a conveyance direction for sheets of paper, and which has a liquid ejecting head (a recording head). During printing, ink droplets are ejected from the liquid ejecting head toward a sheet of paper while the carriage is being moved, whereby an image or the like is printed onto the sheet of paper (for example, Patent Documents 1 to 4, etc.).

In, for example, the printers described in Patent Documents 1 to 4, a light reflection optical sensor (an edge sensor) was provided to the carriage, and a widthwise edge position of the sheet of paper was detected by the optical sensor while the carriage was being moved in the movement direction. More specifically, a detection value from the optical sensor and a threshold value are compared against each other, and when the detection value changes to being the threshold value or lower or to being the threshold value or higher, the current sensor position is determined to be an edge detection position (edge position) of the sheet of paper.

It has been noted that an ink mist generated when the liquid ejecting head ejected the ink droplets was present in the vicinity of a movement path of the carriage, as was suspended matter such as paper dust generated from the sheet of paper due to sliding over a conveyor roller, or the like. When the suspended matter sticks and the optical sensor is fouled, there is a gradual decrease in the amount of light received thereby, whereupon this has resulted in changes to a correction amount used in order to correct for an amount of positional deviation between the edge detection position at which the edge position of the sheet of paper was detected and the actual edge position of the sheet of paper, i.e., to correct by an amount commensurate with this amount of positional deviation. In order to resolve this, in a printer apparatus described in Patent Document 1, a threshold value that is optimal for every iteration is re-determined for every iteration of printing, and thus it is possible to detect the edge position with high positional accuracy by using a threshold value that is optimal and has not been impacted even by aging changes in the surface state of a support base nor by aging changes caused by fouling of the optical sensor.

In the printers described in Patent Documents 2 and 3, a rib of a support base and a portion other than the rib (a groove part) are detected by an optical sensor (a recording sheet detection sensor), a detection sensitivity of the optical sensor is determined on the basis of a ratio between respective detection voltages, and a threshold value corresponding to the detection sensitivity is set. For this reason, there will be a constant amount of positional deviation between the edge detection position of when the detection value of the optical sensor crosses over the threshold value and the actual edge position, and thus the edge position can be detected at high positional accuracy when corrected with a constant correction amount corresponding to the amount of positional deviation thereof.

Japanese Laid-open Patent Publication No. 2002-127521 (for example, paragraphs [0037]-[0052], FIG. 4, FIG. 5, etc.) (Patent Document 1), Japanese Laid-open Patent Publication No. 2003-260829 (for example, paragraphs [0053]-[0059], FIG. 5, FIG. 6, etc.) (Patent Document 2), Japanese Laid-open Patent Publication No. 2010-194748 (Patent Document 3), and Japanese Laid-open Patent Publication No. 2005-329556 (for example, paragraphs [0032], [0037]-[0040], FIG. 9, FIG. 6, etc.) (Patent Document 4) are examples of the related art.

SUMMARY

Problems to be Solved by the Invention

It has been noted that in Patent Documents 2 and 3, the rib of the support base and the section other than the rib (the groove part) are detected by the optical sensor (the recording sheet detection sensor) and a threshold value corresponding to the ratio between the respective detection voltages was set. However, the ratio between the detection voltages for the rib of the support base and for the portion other than the rib (the groove part) has not been accurately indicative of the detection sensitivity. For this reason, a problem has emerged in that the threshold value set in accordance with the ratio of the respective detection voltages also has not been suitable, and in that the detection accuracy of the edge position of a sheet of paper P has not been very high. When, for example, printing is carried out from a print start position in the width direction that has been set in this manner on the basis of the edge position, a concern has emerged in that a surfeit of blank margin may occur at the widthwise edge of the sheet of paper or that a surfeit of ink droplets may be ejected onto a place other than the sheet of paper (a part of the support base).

The present invention has been contrived in the light of the foregoing problems, and one advantage thereof is to provide a liquid ejecting apparatus and a method for detecting a medium edge position in a liquid ejecting apparatus whereby a decline in the accuracy of detecting an edge position of a medium caused by fouling of an optical sensor can be minimized.

Means Used to Solve the Above-Mentioned Problems

In order to achieve the one foregoing advantage, the essence of a first aspect of the present invention resides in being provided with: a liquid ejecting head for ejecting a liquid toward a medium; a light reflection optical sensor which is provided to a carriage for moving reciprocatingly in a movement direction intersecting with a conveyance direction of the medium, has a light-emitting unit and a light-receiving unit, and outputs an output value that corresponds to an amount of light received by the light-receiving unit; a reflection unit that is used in order to reflect light for measurement to the optical sensor; a measurement unit for acquiring a measurement value that corresponds to the amount of light received by the light-receiving unit, on the basis of a first output value of the light-receiving unit receiving reflected light formed when light irradiated from the light-emitting unit is reflected by the reflection unit; a storage unit for storing an initial value of the measurement value; a correction amount acquisition unit for acquiring a correction amount on the basis of a ratio between the measurement value acquired by the measurement unit and the initial value of the measurement value; an edge position detection unit for acquiring an edge detection position of the medium by using a second output value outputted by the light-receiving unit receiving reflected light of light irradiated from the light-emitting unit of the optical sensor moving in the movement direction in a state where the medium has been conveyed to a position at which detection by the optical sensor is possible; and a correction unit for acquiring an edge position of the medium by correcting the edge detection position with the correction amount.

According to the foregoing configuration, the reflected light formed when the light irradiated from the light-emitting unit is reflected by the reflection unit is received by the light-receiving unit, whereby the measurement unit acquires a measurement value that corresponds to the amount of light received at the time on the basis of the first output value of the light-receiving unit at the time. The initial value of the measurement value is stored in the storage unit. The correction amount acquisition unit acquires the correction amount on the basis of the ratio between the measurement value and the initial value of the measurement value. The edge position detection unit acquires the edge detection position of the medium by using the second output value outputted by the light-receiving unit receiving the reflected light of the light irradiated from the light-emitting unit of the optical sensor moving in the movement direction in a state where the medium has been conveyed to a position at which detection by the optical sensor is possible. The correction unit acquires the edge position of the medium by correcting the edge detection position with the correction amount. Relatively high accuracy in detecting the edge position can be ensured, because even when, for example, the optical sensor is fouled and there is a decline in the sensitivity thereof, a proper correction amount that corresponds to the declined sensitivity thereof can be acquired. Accordingly, a decline in the accuracy of detecting the edge position of the medium caused by fouling of the optical sensor can be minimized.

In a liquid ejecting apparatus that is one aspect of the present invention, preferably, the liquid ejecting apparatus is further provided with: a determination unit for determining whether or not a sensitivity of the optical sensor has gone beyond an allowable limit value; and a sensitivity adjustment unit for adjusting the optical sensor to a sensitivity that falls within the allowable limit value in a case where the sensitivity is determined to have gone beyond the allowable limit value.

According to the foregoing configuration, when fouling of the optical sensor or the like has progressed and the sensitivity of the optical sensor is determined by the determination unit to have gone beyond the allowable limit value, the optical sensor is adjusted by the sensitivity adjustment unit to a sensitivity that falls within the allowable limit value. Accordingly, the edge of the medium can be detected even when fouling of the optical sensor or the like has progressed. Also, even when the sensitivity of the optical sensor is altered, the relationship of correspondence between the correction amount and the ratio between the measurement value and the initial value of the measurement value does not change. Accordingly, there is no need to alter the method for acquiring the correction amount either before or after the sensitivity of the optical sensor has been altered, and an edge position detection process is relatively simple.

In a liquid ejecting apparatus that is one aspect of the present invention, preferably, the correction amount acquisition unit stores either table data indicative of the relationship of correspondence between the correction amount and the ratio between the measurement value and the initial value of the measurement value, or a computational formula for computing from the ratio the correction amount that corresponds to the relevant ratio, and acquires the correction amount that corresponds to the relevant ratio either by consulting the table data or by running a computation using the computational formula on the basis of the ratio between the measurement value and the initial value of the measurement value.

According to the foregoing configuration, the correction amount acquisition unit acquires the correction amount corresponding to the relevant ratio either by consulting the table data on the basis of the ratio between the measurement value and the initial value of the measurement value, or by running a computation using the computational formula. For this reason, a correction amount acquisition process and a process for correcting the edge detection position are relatively simple.

In order to achieve the one foregoing advantage, the essence of a second aspect of the present invention resides in being a liquid ejecting apparatus, provided with: a liquid ejecting head for ejecting a liquid toward a medium; a light reflection optical sensor which is provided to a carriage for moving reciprocatingly in a movement direction intersecting with a conveyance direction of the medium and has a light-emitting unit and a light-receiving unit, the light-receiving unit outputting an output value that corresponds to an amount of light received; a reflection unit that is used in order to acquire a parameter for adjusting a sensitivity of the optical sensor; a measurement unit for acquiring a measurement value that corresponds to the amount of light received by the light-receiving unit, on the basis of a first output value of the light-receiving unit receiving reflected light formed when light irradiated from the light-emitting unit is reflected by the reflection unit; a storage unit for storing an initial value of the measurement value; a parameter acquisition unit for acquiring the parameter for adjusting the sensitivity, on the basis of a ratio between the measurement value acquired by the measurement unit and the initial value of the measurement value; a sensitivity adjustment unit for adjusting the sensitivity of the optical sensor on the basis of the parameter; and an edge position detection unit for detecting an edge position of the medium by using a second output value outputted by the light-receiving unit receiving reflected light of light irradiated from the light-emitting unit of the optical sensor moving in the movement direction in a state where the medium has been conveyed to a position at which detection by the optical sensor is possible.

According to the foregoing configuration, the sensitivity adjustment unit adjusts the sensitivity of the optical sensor on the basis of the parameter acquired by the parameter acquisition unit on the basis of the ratio between the measurement value and the initial value of the measurement value, the measurement value corresponding to the amount of light received by the light-receiving unit based on the first output value of the light-receiving unit receiving the reflected light formed when the light irradiated from the light-emitting unit is reflected by the reflection unit. For this reason, even when fouled, the optical sensor is adjusted to a relatively proper sensitivity. The edge position detection unit detects the edge position of the medium by using the second output value outputted by the light-receiving unit receiving the reflected light of the light irradiated from the light-emitting unit of the optical sensor moving in the movement direction in a state where the medium has been conveyed to a position at which detection by the optical sensor is possible. At this time, because the optical sensor has been adjusted to a relatively proper sensitivity, it is possible to have a substantially constant amount of positional deviation between the edge detection position of the medium and the actual edge position. Even in a provisional case where the amount of positional deviation cannot be ignored for the sake of accuracy and a correction is needed, the edge position of the medium can be acquired relatively simply and correctly by, for example, using a constant correction amount to correct the edge detection position. Accordingly, a decline in the accuracy of detecting the edge position of the medium caused by fouling of an optical sensor can be minimized.

In a liquid ejecting apparatus that is one aspect of the present invention, preferably, the liquid ejecting apparatus is further provided with a determination unit for determining whether or not the parameter has gone beyond an allowable limit value corresponding to a sensitivity upper limit value, and the sensitivity adjustment unit gives priority to adjusting a sensitivity of the light-receiving unit so long as the parameter has not gone beyond the allowable limit value but, when the parameter has gone beyond the allowable limit value, thereafter adjusts an amount of light emitted by the light-emitting unit.

According to the foregoing configuration, a determination is made by the determination unit as to whether or not the parameter has gone beyond the allowable limit value. The sensitivity adjustment unit adjusts the sensitivity of the optical sensor by giving priority to adjusting a sensitivity of the light-receiving unit so long as the parameter has not gone beyond the allowable limit value but, when the parameter has gone beyond the allowable limit value, thereafter adjusting the amount of light emitted by the light-emitting unit. Accordingly, the power consumed by the optical sensor can be minimized, because priority is given to adjusting the sensitivity of the light-receiving unit over increasing the amount of light emitted by the light-emitting unit.

In a liquid ejecting apparatus that is one aspect of the present invention, preferably, the parameter acquisition unit acquires the parameter that makes it possible to keep the ratio to a constant value. According to the foregoing configuration, because a parameter that makes it possible to keep the ratio between the measurement value and the initial value of the measurement to a constant value, adjusting the sensitivity of the optical sensor on the basis of the parameter makes it possible to give the optical sensor a sensitivity equivalent to the sensitivity of when the initial value of the measurement value was acquired.

In a liquid ejecting apparatus that is one aspect of the present invention, preferably, the sensitivity adjustment unit calculates a constant that makes it possible to keep the ratio at a constant value, and adjusts the second output value by multiplying by the constant.

According to the foregoing configuration, a constant that makes it possible to keep the ratio between the measurement value and the initial value of the measurement value to a constant value is multiplied by the second output value, whereby the second output value is adjusted. Accordingly, a second output value equivalent to the output value at the sensitivity of when the optical sensor acquired the initial value of the measurement value can be acquired. As such, a correction amount can be kept constant for cases when the edge position of the medium has been detected using the second output value.

In order to achieve the one foregoing advantage, the essence of one aspect of the present invention resides in being a method for detecting a medium edge position in a liquid ejecting apparatus, the method including: a measurement step for measuring a first output value that corresponds to an amount of light received by a light-receiving unit receiving reflected light formed when light irradiated from a light-emitting unit of an optical sensor is reflected by a reflection unit for optical measurement; a correction amount acquisition step for acquiring a correction amount on the basis of a ratio between the first output value acquired in the measurement step and an initial value of the first output value; an edge position detection step for acquiring an edge detection position of the medium by using a second output value outputted by the light-receiving unit receiving reflected light of light irradiated from the light-emitting unit of the optical sensor moving in a movement direction intersecting with a conveyance direction of the medium, in a state where the medium has been conveyed to a position at which detection by the optical sensor is possible; and a correction step for acquiring an edge position of the medium by correcting the edge detection position with the correction amount. According to the foregoing method, a similar effect to that of the first aspect of the present invention as in the liquid ejecting apparatus can be obtained.

In order to achieve the one foregoing advantage, the essence of one aspect of the present invention resides in being a method for detecting a medium edge position in a liquid ejecting apparatus, the method including: a measurement step for measuring a first output value of a light-receiving unit receiving reflected light formed when light irradiated from a light-emitting unit of an optical sensor is reflected by a reflection unit; a parameter acquisition step for acquiring a parameter for adjusting a sensitivity, on the basis of a ratio between the first output value acquired in the measurement step and an initial value of the first output value; a sensitivity adjustment step for adjusting the sensitivity of the optical sensor on the basis of the parameter; and an edge position detection step for detecting an edge position of the medium by using a second output value outputted by the light-receiving unit receiving reflected light of light irradiated from the light-emitting unit of the optical sensor moving in a movement direction intersecting with a conveyance direction of the medium, in a state where the medium has been conveyed to a position at which detection by the optical sensor is possible. According to the foregoing method, a similar effect to that of the second aspect of the present invention as in the liquid ejecting apparatus can be obtained.

BRIEF DESCRIPTION OF THE DRAWINGS

Referring now to the attached drawings which form a part of this original disclosure:

FIG. 3B is a block diagram illustrating a functional configuration of a control unit;

DETAILED DESCRIPTION OF EXEMPLARY EMBODIMENTS

First Embodiment

The following describes a first embodiment, in which the liquid ejecting apparatus of the present invention is embodied as an inkjet printer, with reference to FIGS. 1 to 17.

Figure 1:
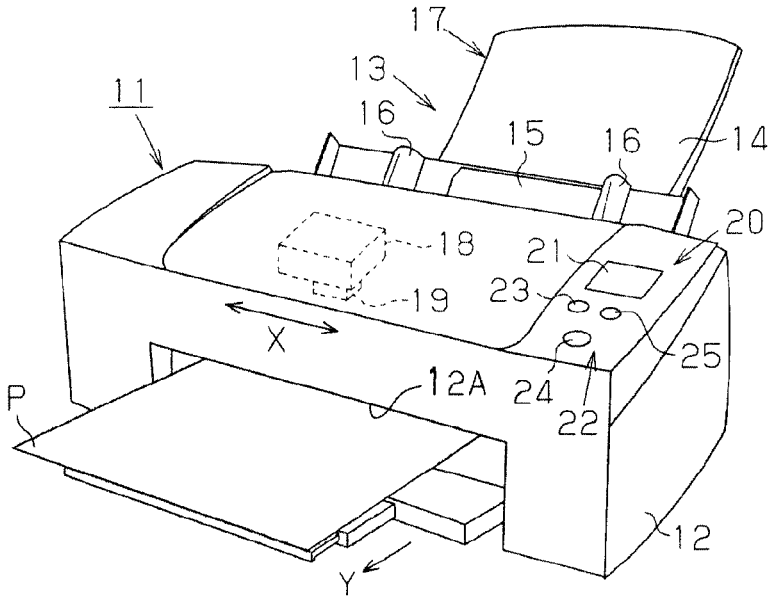
FIG. 1 is a perspective view of a printer in a first embodiment.

As illustrated in FIG. 1, the inkjet printer which is one example of the liquid ejecting apparatus (hereinafter, simply called a "printer 11") is equipped with an auto sheet feeder device 13 for conveying a sheet of paper P (sheet), serving as one example of medium, at the rear side of a main body 12. The auto sheet feeder device 13 is provided with a sheet feeder tray 14, a hopper 15, and a paper sheet guide 17 having edge guides 16, and feeds sheets of paper having been set into the paper sheet guide 17 one sheet at a time to the inside of the main body 12. The left/right pair of edge guides 16 guide a sheet of paper P in the width direction, centered on a widthwise middle position of the sheet feeder tray 14.

Inside of the main body 12, a carriage 18 is provided in a state allowing reciprocating movement in a movement direction X (a main scanning direction) along a movement path thereof, and a liquid ejecting head 19 is attached at a lower part of the carriage 18. Substantially in alternation, the printer 11 repeats a recording operation, in which ink droplets are ejected onto the surface of the sheet of paper P from the liquid ejecting head 19 while the carriage 18 is in the process of moving in the movement direction X, and a sheet feed operation, in which the sheet of paper P is conveyed by a requested conveyance amount in a conveyance direction Y (a secondary scanning direction) intersecting with the movement direction X; an image, text, or the like based on given print data is printed onto the sheet of paper P. The sheet of paper P after printing is discharged from a sheet discharge port 12A opening on a front side lower part of the main body 12.

An operation panel 20 is also provided to an upper surface end part of the main body 12. Provided to the operation panel 20 are a display unit 21, including a liquid crystal display panel or the like, and an operation switch 22. Provided to the operation switch 22 are a power source switch 23, a print start switch 24, a cancel switch 25, and the like. The display unit 21 may be a touch panel.

Figure 2:
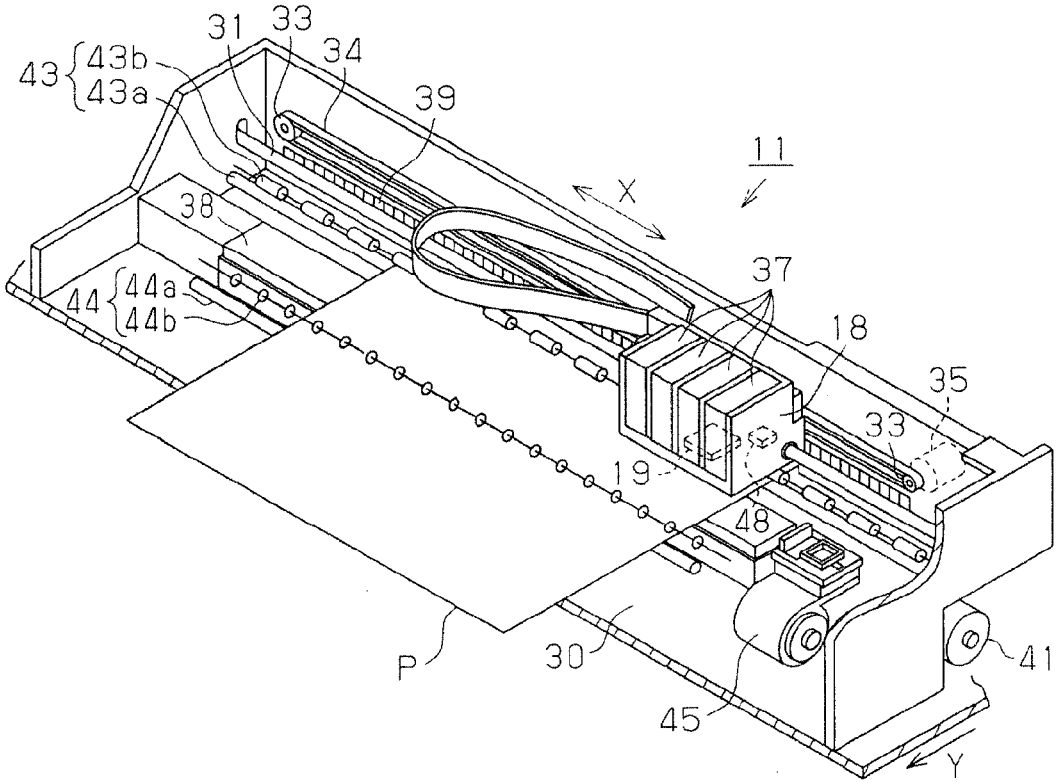
FIG. 2 is a perspective view illustrating a configuration of a printer.

Next, the internal configuration of the printer 11 shall be described. As is illustrated in FIG. 2, the printer 11 has a substantially quadrangular box-shaped main body frame 30, the upper side and front side of which are open; the carriage 18 is attached in a state allowing reciprocating movement in the main scanning direction X at a guide shaft 31, which is bridged between left and right side walls of the main body frame 30 in FIG. 2. An endless timing belt 34 is wound about a pair of pulleys 33 mounted onto an inner surface of a back plate of the main body frame 30, and the carriage 18 is fixed to a part of the timing belt 34. Coupled to the right-side pulley 33 in FIG. 2 is a drive shaft (output shaft) of a carriage motor 35; when the carriage motor 35 is driven forward and in reverse and the timing belt 34 turns forward and in reverse, the carriage 18 is thereby moved reciprocatingly in the movement direction X (the main scanning direction).

A plurality (for example, four) of ink cartridges 37 in which different colors of ink (for example, the four colors of black (K), cyan (C), magenta (M), and yellow (Y)) are respectively contained are loaded into an upper part of the carriage 18. Ink that is supplied from each of the ink cartridges 37 is respectively ejected from nozzles in a corresponding nozzle row NA (see FIG. 5), there being the same number of nozzle rows formed on the liquid ejecting head 19 (in the present example, four) as there are colors of ink. A support base 38 for regulating the interval (gap) between the liquid ejecting head 19 and the sheet of paper P is provided to a position below the movement path of the carriage 18 so as to extend in the main scanning direction X. The ink colors that can be ejected by the liquid ejecting head 19 need not be four in number; there may also be one color, three colors, or five to eight colors.

A linear encoder 39 for outputting a number of pulses that is proportional to an amount of travel by the carriage 18 is provided to a back surface side of the carriage 18 so as to extend along the guide shaft 31. In the printer 11, positional control and speed control of the carriage 18 are carried out on the basis of a pulse signal that is outputted from the linear encoder 39.

A conveyance motor 41 is disposed at a right-side lower part in FIG. 2 of the main body frame 30. A sheet feeder roller (not shown) is driven by the power of the conveyance motor 41, whereby the sheets of paper P that have been set into the sheet feeder tray 14 (see FIG. 1) are fed out one sheet at a time. A conveyor roller pair 43 and a discharge roller pair 44 are arranged on a downstream side and upstream side thereof, respectively, sandwiching the support base 38 in the conveyance direction Y. Each of the roller pairs 43, 44 includes a drive roller 43*a*, 44*a* that is rotated by the power of the conveyance motor 41 and a driven roller 43*b*, 44*b* that turns together with the rotation of the drive roller 43*a*. When the conveyance motor 41 is driven, the sheet of paper P is thereby conveyed in the conveyance direction Y (the secondary scanning direction) in a state of being sandwiched (nipped) between the two roller pairs 43, 44.

In FIG. 2, a position at one end on the movement path of the carriage 18 (in FIG. 2, this is the rightmost position) serves as a home position at which the carriage 18 remains on standby when printing is not taking place. A maintenance device 45 for cleaning and otherwise maintaining the liquid ejecting head 19 is disposed directly below the carriage 18 arranged at the home position. In the present embodiment, the conveyance motor 41 also serves as a source of power for the maintenance device 45. In addition, a sheet width sensor 48, serving as one example of an optical sensor, for detecting the ends (edges) on both sides of the sheet of paper P in the width direction (the movement direction X) is provided to the carriage.

Figure 5:
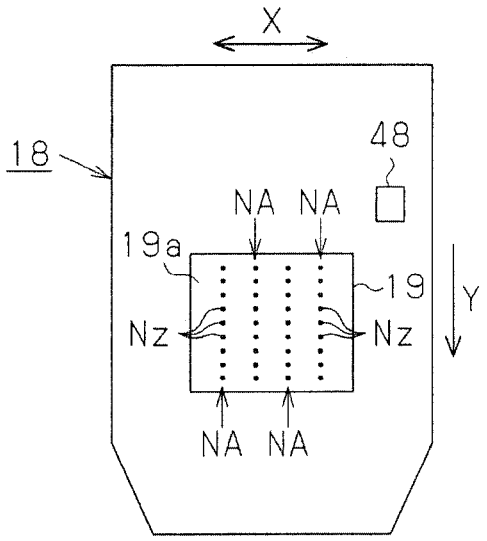
FIG. 5 is a bottom view of a liquid ejecting head.

FIG. 5 illustrates the bottom of the carriage. A plurality of nozzle rows NA, formed by a plurality of nozzles Nz being arrayed at a constant pitch in the conveyance direction Y in a state where the carriage 18 has been assembled in the printer 11, are arrayed at a predetermined spacing in the movement direction X on a nozzle formation surface 19*a* of the liquid ejecting head 19, which is attached to a substantially middle position of the bottom of the carriage 18. The ink that is supplied from the corresponding ink cartridge 37 is ejected from the nozzles Nz constituting the nozzle rows NA. The sheet width sensor 48 is attached on the bottom of the carriage 18 to a position farther on the upstream side in the conveyance direction Y than the liquid ejecting head 19.

Figure 3A:
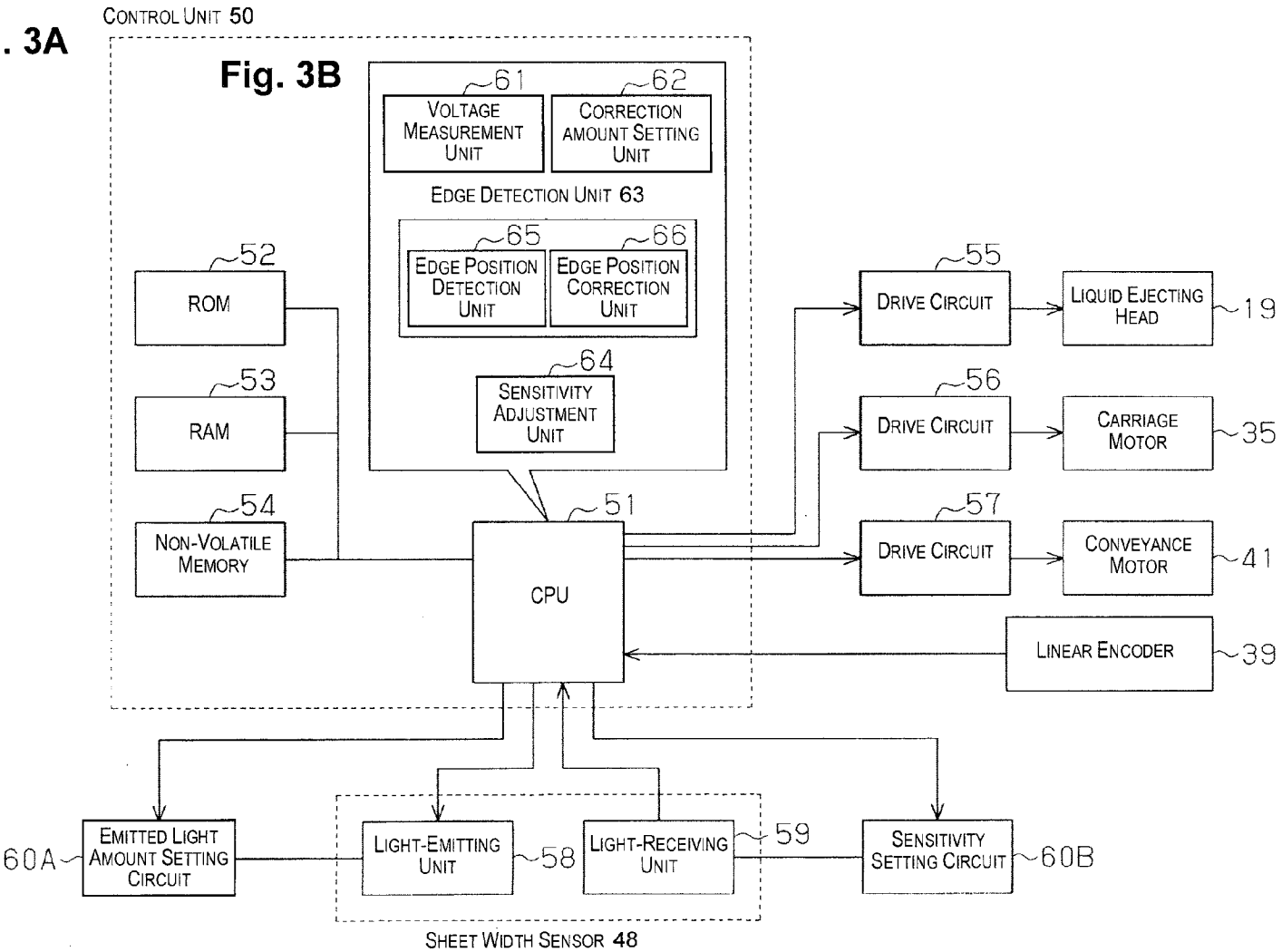
FIG. 3A is a block diagram illustrating an electrical configuration of a printer.

The electrical configuration of the printer 11 shall now be described on the basis of FIG. 3. The printer 11 illustrated in FIG. 3 is provided with a control unit 50 for governing the overall control thereof. The control unit 50 is constituted of, for example, a computer (a microcomputer), and is provided with a CPU 51 (a central processing unit), a ROM 52, a RAM 53, and a non-volatile memory 54. The ROM 52 stores a variety of types of programs. Some programs, setting data for when a variety of types of programs are to be executed, and the like are stored in the non-volatile memory 54, which also retains the stored contents even when the power is turned off. The CPU 51 controls the print operation of the printer 11 and the like by executing programs stored in the ROM 52 and in the non-volatile memory 54. An application specific integrated circuit (ASIC) may also be added, with the data processing needed for drive control of the liquid ejecting head 19 and the like then being performed by the ASIC.

The control unit 50 drives and controls the liquid ejecting head 19 via a drive circuit 55 on the basis of print data, and causes ink to be ejected from the liquid ejecting head 19. The control unit 50 also drives and controls the carriage motor 35 via a drive circuit 56, and causes the carriage 18 to move reciprocatingly in the movement direction X. The control unit 50 further drives and controls the conveyance motor 41 via a drive circuit 57, and causes the sheet of paper P to be conveyed in the conveyance direction Y. The control unit 50 detects a position of the carriage 18 (carriage position) in the movement direction X, with the home position as the point of origin, on the basis of a pulse signal inputted from the linear encoder 39. More specifically, the control unit 50 is provided with a counter for using the point in time where the carriage 18 is at the home position as the point of origin to count the number of pulse edges of the pulse signal inputted from the linear encoder 39, and increments the count of the counter upon forward movement of the carriage 18 and decrements the count upon return movement of the carriage 18. For this reason, the count of the counter is indicative of the position of the carriage 18 in the movement direction X (the carriage position).

The sheet width sensor 48, which is connected to the control unit 50, is provided with a light-emitting unit 58 for irradiating light towards the support base 38 (downward in the vertical direction) and a light-receiving unit 59 for receiving reflected light of the light irradiated from the light-emitting unit 58. The control unit 50 controls the light emission from the light-emitting unit 58, and receives the input of an output voltage corresponding to the amount of light received thereby from the light-receiving unit 59. The control unit 50 is connected to an emitted light amount setting circuit 60A for setting the amount of light emitted by the light-emitting unit 58, and adjusts the amount of light emitted by the light-emitting unit 58 by altering an emitted light amount setting value in the emitted light amount setting circuit 60A. The control unit 50 is also connected to a sensitivity setting circuit 60B for setting the sensitivity of the light-receiving unit 59, and adjusts the sensitivity of the light-receiving unit 59 by altering a sensitivity setting value in the sensitivity setting circuit 60B.

FIG. 3B illustrates a functional configuration which functions by the CPU 51 executing a program that is read from the ROM 52 or the non-volatile memory 54. The control unit 50 is provided with a voltage measurement unit 61, a correction amount setting unit 62, an edge detection unit 63, and a sensitivity adjustment unit 64, as functional units that function by the CPU 51 executing a program. The voltage measurement unit 61 acquires an output voltage VL, serving as one example of a first output value, that is outputted by the light-receiving unit 59 having received reflected light of the light with which a reference reflecting surface has been irradiated by the sheet width sensor 48, and measures a reference surface voltage Vs corresponding to the amount of light received by the light-receiving unit 59 having received the reflected light reflected by the reference reflecting surface on the basis of the output voltage VL. The correction amount setting unit 62 sets a correction amount that corresponds to a ratio between the reference surface voltage Vs and an initial value Vs0 of the reference surface voltage Vs. A method for setting the correction amount shall be described in greater detail below. In the present embodiment, one example of a measurement unit is constituted by the voltage measurement unit 61. One example of a correction amount acquisition unit is constituted by the correction amount setting unit 62.

The edge detection unit 63 detects the position of the edge of the sheet of paper P in the width direction on the basis of the output voltage that is inputted from the light-receiving unit 59. The edge detection unit 63 is provided with an edge position detection unit 65 and an edge position correction unit 66, which serves as one example of a correction unit, in order to detect the edge position of the sheet of paper P.

The edge position detection unit 65 detects the edge of the sheet of paper P in response to when the output voltage crosses over a threshold value, from a comparison between the output voltage of the sheet width sensor 48 and the threshold value, and acquires the edge of the sheet width sensor 48 at the time of this detection as the edge position (end position) of the sheet of paper P. More specifically, the position of the sheet width sensor 48 is ascertained on the basis of the position of the carriage 18 in the width direction X (the carriage position) as ascertained on the basis of the pulse signal of the linear encoder 39 and of the known distance between this carriage position and the position of the sheet width sensor 48 in the movement direction X. The edge detection unit 63, upon detecting the edge of the sheet of paper P in response to the crossing of the output voltage of the sheet width sensor 48 over the threshold value, acquires the position of the sheet width sensor 48 at that time, i.e., an edge detection position Xd (end detection position) of the sheet of paper P, on the basis of the count of the counter for counting the position of the carriage 18 and the aforementioned known distance (a counter conversion value).

The edge position correction unit 66 acquires an edge position Xe (end position) by correcting the edge detection position Xd with a correction amount dx (Xe=Xd+dx). Herein, the correction amount dx is set by the correction amount setting unit 62.

The sensitivity adjustment unit 64 adjusts the sensitivity of the light-receiving unit 59 in response to when the emitted light amount setting value in the emitted light amount setting circuit 60A is altered. In a case where the sheet width sensor 48 has been fouled because of adhesion of floating matter, such as the ink mist or the paper dust, and the edge position detection accuracy has been determined to have declined beyond an allowable range, then the sensitivity adjustment unit 64 alters the setting value of the emitted light amount setting circuit 60A and alters the sensitivity of the light-receiving unit 59 so as to be higher.

The sensitivity adjustment unit 64 adjusts the sensitivity of the light-receiving unit 59 in response to when the sensitivity setting value in the sensitivity setting circuit 60B has been altered. In a case where the sheet width sensor 48 has been fouled because of adhesion of floating matter, such as the ink mist or the paper dust, and the edge position detection accuracy has been determined to have declined beyond an allowable range, then the sensitivity adjustment unit 64 alters the setting value of the sensitivity setting circuit 60B and alters the sensitivity of the light-receiving unit 59 so as to be higher. In the present embodiment, the switching of the sensitivity by the sensitivity adjustment unit 64 is carried out first, and when, after a switch to an ultimate sensitivity has been carried out, the edge position detection accuracy is determined to have declined beyond the allowable range with the ultimate sensitivity, then the sensitivity adjustment unit 64 carries out an emitted light amount switch control for altering the setting value of the emitted light amount setting circuit 60A and increasing the amount of light emitted by the light-emitting unit 58 to one stage higher.

Figure 4:
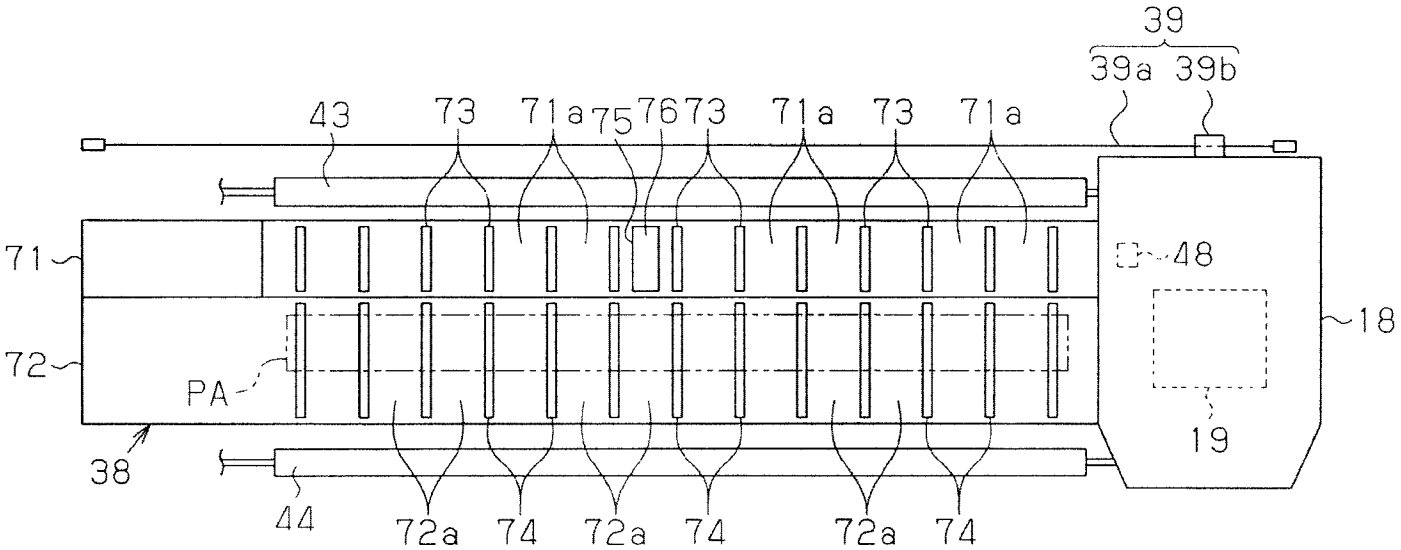
FIG. 4 is a schematic plan view illustrating a carriage, a support base, and so forth.

FIG. 4 illustrates the support base and the carriage. Formed on the support base 38 are an upstream support surface 71 located on the upstream side in the conveyance direction Y and a downstream support surface 72 located on the downstream side in the conveyance direction Y with respect to the upstream support surface 71. Upstream ribs 73 that project out upward in the vertical direction (the front side of the plane of the paper in FIG. 4) and extend in the conveyance direction Y are formed on the upstream support surface 71. Downstream ribs 74 that project out upward in the vertical direction and extend in the conveyance direction Y are formed on the downstream support surface 72. From the lower side in the vertical direction, both the upstream ribs 73 and the downstream ribs 74 support the sheet of paper P being conveyed, and the sheet of paper P illustrated in FIG. 2 is conveyed along the upstream ribs 73 and the downstream ribs 74.

As illustrated in FIG. 4, groove parts 71*a* which have a lower bottom than an uppermost surface of the upstream ribs 73 are formed on portions other than the upstream ribs 73 in the upstream support surface 71. Also, groove parts 72*a*, which have a lower bottom than an upper end surface of the downstream ribs 74, are formed on portions other than the downstream ribs 74 on the downstream support surface 72.

As illustrated in FIG. 4, a base part 75 is formed between a pair of the upstream ribs 73 at a substantially middle position in the movement direction X on the upstream support surface 71. A reference reflecting surface 76 that is used in the process of detecting the extent of fouling (degree of fouling) of the sheet width sensor 48 caused by the adhesion of floating matter, such as the ink mist or paper dust, onto the sheet width sensor 48 is formed at the top (upper end) of the base part 75. The reference reflecting surface 76 is a reflecting surface by which the light from the light-emitting unit 58 is reflected and which serves as a reference surface for when the light reflected thereby is received by the light-receiving unit 59 and the degree of fouling of the sheet width sensor 48 is studied on the basis of the output voltage therefrom; the reference reflecting surface is finished to a flat mirror surface that is parallel to the nozzle formation surface 19*a* of the liquid ejecting head 19.

Figure 6:
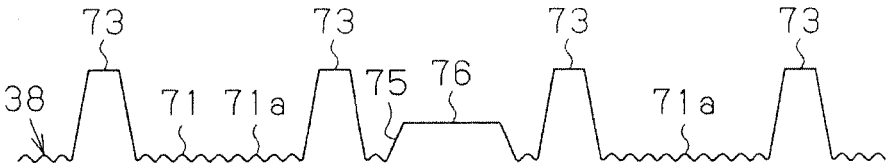
FIG. 6 is a schematic front view illustrating one part of a support base.

As illustrated in FIGS. 4 and 6, the height of the base part 75 is lower than that of the upstream ribs 73. For this reason, the reference reflecting surface 76, which is the top surface of the base part 75, will not be abraded by the sliding of the sheet of paper P, because the sheet of paper P does not slide thereon. Also, the base part 75 is covered by the sheet of paper P during printing, and thus there is little risk of contamination caused by the ink mist. In a case where the degree of fouling of the sheet width sensor 48 is being studied, it is necessary to eliminate the factors by which the reflectivity of the reference reflecting surface 76 fluctuates, but because the sheet of paper P does not slide on the base part 75 and because the base part is covered by the sheet of paper P during printing, the reflectivity of the reference reflecting surface 76 is less likely to fluctuate.

The plane direction of the reference reflecting surface 76 is orthogonal to the irradiation direction of the light-emitting unit 58 (the vertically downward direction). The sensitivity of the light-receiving unit 59 is switched in a stepwise manner and the amount of light emitted by the light-emitting unit 58 is switched in a stepwise manner in accordance with the extent of fouling of the sheet width sensor 48 as detected by using the reference reflecting surface 76.

In FIG. 4, the right edge position at which the carriage 18 is located serves as the home position. A liquid ejecting region PA (print region), which is the maximum area where the liquid ejecting head 19 is able to eject ink drops for printing in the movement direction X of the carriage 18, is located atop the downstream support surface 72, as illustrated by the two-dot chain line in FIG. 4. The base part 75 is arranged on the upstream support surface 71 located further upstream in the conveyance direction Y than the downstream support surface 72, at which the liquid ejecting region PA is located, and thus the reference reflecting surface 76 is located outside of the liquid ejecting region PA.

The sheet of paper P, which is positioned in the width direction by the pair of edge guides 16 illustrated in FIG. 1, is fed out so that the width center thereof passes through a widthwise middle position of the conveyance path. For this reason, the positions of the edges of both sides (the edge positions) in the width direction of the sheet of paper P when the sheet of paper is conveyed over the support base 38 in FIG. 4 are determined by the width of the sheet of paper P. In the present embodiment, the position of each of the upstream ribs 73 in the movement direction X is set for a sheet of paper P of a prescribed size so that the two edge positions thereof in the width direction are positioned to face the groove parts 71*a*. Because of this, the two widthwise edges of the sheet of paper P having been conveyed over the support base 38 are positioned to face the groove parts 71*a* at all times.

As illustrated in FIG. 6, the bottom of the groove parts 71*a* is formed to be a relatively fine, wavy surface, and light that is irradiated substantially perpendicularly to the groove parts 71*a* from the light-emitting unit 58 is more prone to scattered reflection. For this reason, a lesser amount of light that is reflected by the groove parts 71*a* is received by the light-receiving unit 59, and the output voltage thereof is correspondingly larger. The output voltage of the light-receiving unit 59 receiving the reflected light from the sheet of paper P is also correspondingly smaller. In the present embodiment, the threshold value is set to be between the output voltage of the light-receiving unit 59 for when the reflecting surface of the light irradiated from the light-emitting unit 58 is the groove parts 71*a* and the output voltage of the light-receiving unit 59 for when the reflecting surface is the sheet of paper P. Then, the edge of the sheet of paper P in the width direction is detected in response to the crossing of the output voltage of the light-receiving unit 59 over the threshold value. Then, the edge position (end position) of the sheet of paper P in the width direction is detected from the position of the sheet width sensor 48 at the point in time where the edge of the sheet of paper P was detected. Further, the edge detection unit 63 (see FIG. 3) acquires the edge position of the sheet of paper P by correcting the edge position of the sheet of paper P with the correction amount. Such a process for detecting the edge position of the sheet of paper P is performed by the edge detection unit 61.

Figure 7:
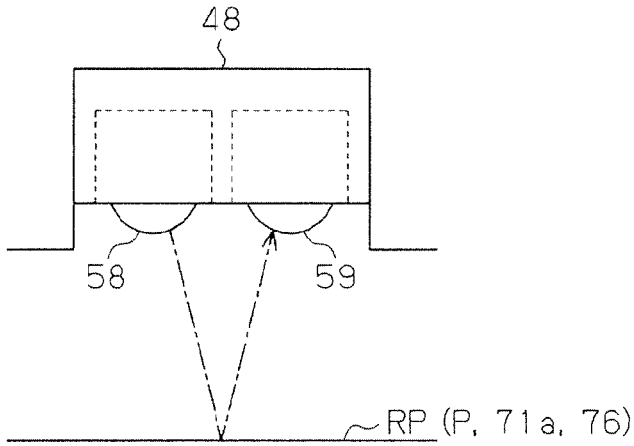
FIG. 7 is a schematic front view illustrating a sheet width sensor.

The sheet width sensor 48, which is fixed to a side opposite to the support base 38 (the lower surface side) on the carriage 18, as illustrated in FIG. 7, is attached in a relatively close state where the light-emitting unit 58 and the light-receiving unit 59 are adjacent to each other. The distance between the optical axes of the light-emitting unit 58 and the light-receiving unit 59 is very short, and light that is irradiated vertically downward from the light-emitting unit 58 is reflected by a reflecting surface RP of an object intended to be irradiated with light, where reflected light reflected substantially vertically upward is received by the light-receiving unit 59. In FIG. 7, the optical paths of the irradiated light and the reflected light are schematically illustrated with obliquely extending one-dot chain lines, but the actual irradiated light and actual reflected light can be approximated as a column of light that extends in a substantially vertical direction, having been condensed by a condenser lens. The reflecting surface RP of the object intended to be irradiated with light could be the surface of the sheet of paper P, the groove parts 71*a*, the reference reflecting surface 76, and so forth.

Figure 8:
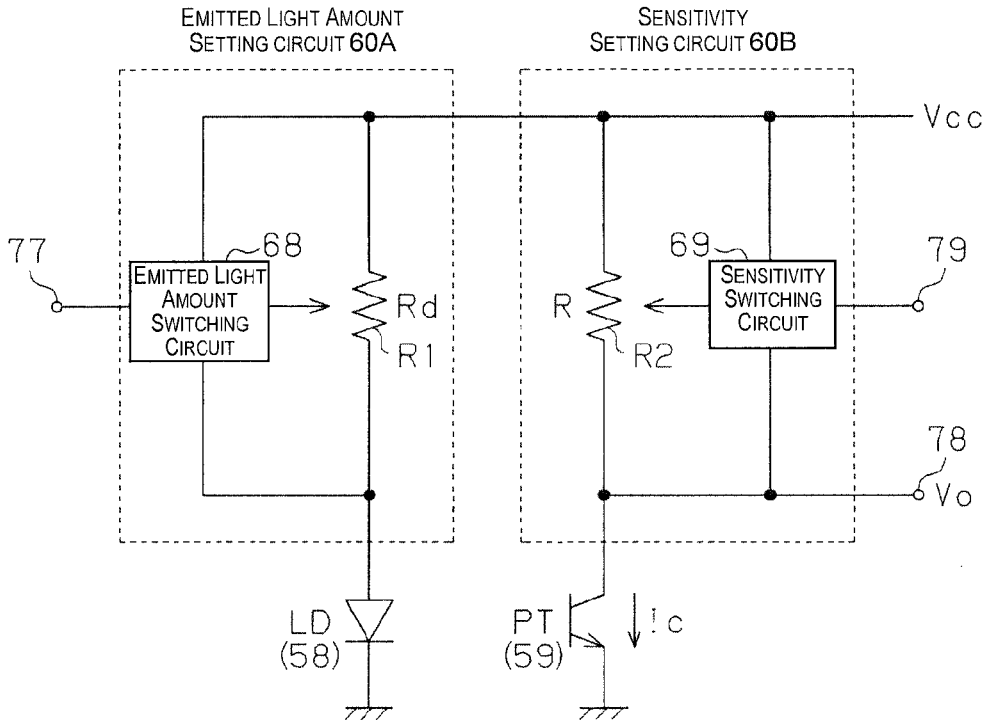
FIG. 8 is a circuit diagram illustrating a sheet width sensor, an emitted light amount setting circuit, and a sensitivity setting circuit.

The following describes the emitted light amount setting circuit 60A and the sensitivity setting circuit 60B, on the basis of FIG. 8. As illustrated in FIG. 8, the emitted light amount setting circuit 60A is configured to include a resistor R1 (a limiting resistor) and an emitted light amount switching circuit 68. The sensitivity setting circuit 60B is configured to include a resistor R2 (a pull-up resistor) and a sensitivity switching circuit 69.

A cathode of a light-emitting diode LD, which is the light-emitting unit 58, is grounded, and an anode of the light-emitting diode LD is connected to one end of the resistor R1, and a power source voltage Vcc is applied to the other end of the resistor R1. The anode of the light-emitting diode LD is connected to one end of the emitted light amount switching circuit 68, and the power source voltage Vcc is applied to the other end of the emitted light amount switching circuit 68. A terminal unit 77 is connected to a controlling input terminal of the emitted light amount switching circuit 68.

The CPU 51 adjusts a resistance value Rd of the resistor R1 by outputting a control signal to the emitted light amount switching circuit 68 via the terminal unit 77. Accordingly, the amount of light emitted by the light-emitting unit 58 including the light-emitting diode LD is adjusted on the basis of the control signal inputted to the emitted light amount switching circuit 68 by the CPU 51 via the terminal unit 77.

When light is received by a phototransistor PR, which is the light-receiving unit 59, a photocurrent Ic flows between an emitter and a collector of the phototransistor PT, and an output voltage V0 is detected at a terminal unit 78 that is connected to the collector of the phototransistor PT.

The emitter of the phototransistor PT is grounded, and the collector of the phototransistor PT is connected to one end of the resistor R2; the power source voltage Vcc is applied to the other end of the resistor R2. Also, the collector of the phototransistor PT is connected to one end of the sensitivity switching circuit 69, and the power source voltage Vcc is applied to the other end of the sensitivity switching circuit 69.

The terminal unit 79 is connected to a controlling input terminal of the sensitivity switching circuit 69. The CPU 51 adjusts a resistance value R of the resistor R2 by inputting a control signal to the sensitivity switching circuit 69 via a terminal unit 79. In the present embodiment, the amount of light emitted by the light-emitting unit 58 including the light-emitting diode LD is adjusted by adjusting the resistance value Rd of the resistor R1 on the basis of the control signal inputted to the emitted light amount switching circuit 68 by the sensitivity adjustment unit 64 (see FIG. 3) via the terminal unit 77.

A current corresponding to the resistance value R of the resistor R2 flows to the collector of the phototransistor PT. In the present embodiment, the sensitivity of the light-receiving unit 59 including the phototransistor PT is adjusted by adjusting the resistance value R of the resistor R2 on the basis of the control signal inputted to the sensitivity switching circuit 69 by the sensitivity adjustment unit 64 (see FIG. 3) via the terminal unit 79.

The control signal is, for example, a pulse width modulation (PWM) signal. The sensitivity adjustment unit 64 has, for example, a built-in PWM generation circuit (not shown) and, by adjusting a duty ratio, which is the ratio of the pulse width relative to the period of the PWM signal, is able to control the PWM signal that is outputted to the sensitivity switching circuit 69 from the PWM generation circuit, and to switch the sensitivity of the light-receiving unit 59 between a plurality of stages (for example, three stages). Also, by adjusting the duty ratio that is imparted to the PWM generation circuit, the sensitivity adjustment unit 64 is able to control the PWM signal outputted to the emitted light amount switching circuit 68 from the PWM generation circuit and switch the amount of light emitted by the light-emitting unit 58 between a plurality of stages. The sensitivity adjustment unit 64 of the present embodiment adjusts the sensitivity of the sheet width sensor 48 by combining the adjustment of the amount of light emitted by the light-emitting unit 58 and the adjustment of the sensitivity of the light-receiving unit 59. The number of stages for switching the sensitivity of the light-receiving unit 59 and the amount of light emitted by the light-emitting unit 58 can be set as appropriate, and the switching may be of a plurality of stages, for example, a two-stage switch, a four-stage switch, or more. Also, the internal resistances of the emitted light amount switching circuit 68 and the sensitivity switching circuit 69 are sufficiently small in comparison to the resistance values Rd and R of the resistors R1 and R2.

Figure 9A:
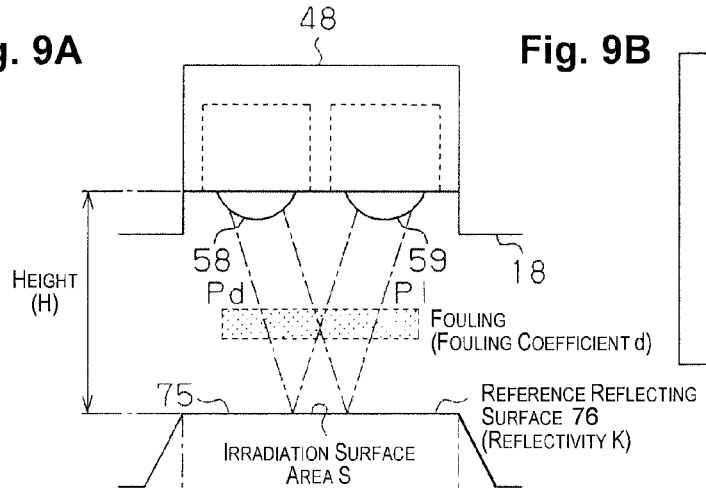
FIG. 9A is a schematic diagram for describing an amount of light received when a sheet width sensor has been fouled.
Figure 9B:
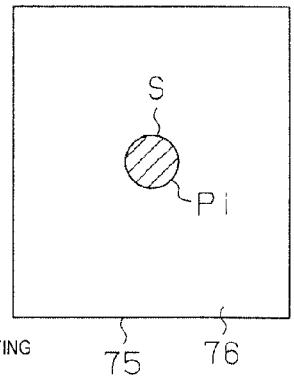
FIG. 9B is a schematic plan view of a reference reflecting surface.
Figure 9C:
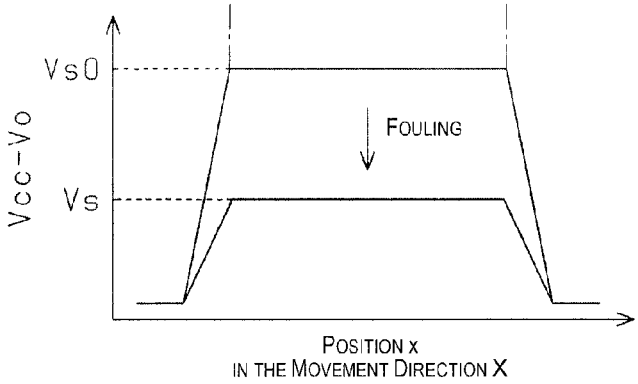
FIG. 9C is a graph illustrating the relationship between a position and a reference surface voltage.

The following describes the relationship between fouling of the sheet width sensor 48 and the decline in sensitivity thereof, on the basis of FIGS. 9A-9C. FIG. 9A schematically depicts the manner in which light is emitted and received using the light-emitting unit 58 and the light-receiving unit 59 of the sheet width sensor 48. In FIG. 9A, the light irradiated from the light-emitting unit 58 is reflected by the reference reflecting surface 76, and the path of the light and the amount of light are schematically illustrated until when the reflected light is finally received by the light-receiving unit 59. For this reason, the amount of light irradiated in the drawing (hereinafter called the "amount Pd of irradiated light") is indicative of the portion of irradiated light irradiated from the light-emitting unit 58 that is reflected by the reference reflecting surface 76 and finally received by the light-receiving unit 59. The reflected light reflected by the reference reflecting surface 76 in the drawing is indicative of the amount of light of the portion of this reflected light that is received by the light-receiving unit 59 (hereinafter called the "amount Pi of reflected light"). The amount Pi of reflected light is accordingly equivalent to the amount of light that is received by the light-receiving unit 59 (the amount of light received).

FIG. 9A also illustrates the manner in which fouling is interposed between the sheet width sensor 48 and the reference reflecting surface 76. Examples of fouling include fouling caused by adhered matter formed by the adhesion of floating matter such as the ink mist or the paper dust, and this fouling includes the respective fouling adhered to the light-emitting unit 58 and to the light-receiving unit 59 as well as the fouling adhered to the reference reflecting surface 76. In FIG. 9A, all fouling through which light passes on the path of the light going from the light-emitting unit 58 to the light-receiving unit 59 is inclusively understood to be fouling.

As illustrated in FIG. 9A, the amount Pd of irradiated light is given by the following formula, where Rd is the resistance value of the resistor R1 on the light-emitting unit 58 side, D is an element coefficient for the light-emitting diode LD, and d is a fouling coefficient.

$$Pd=Vcc/Rd\times D\times d \quad (1)$$

Herein, the element coefficient D is a coefficient that is indicative of the relationship between the current that flows through the light-emitting diode LD and the amount of light emitted. The fouling coefficient d is a coefficient that is indicative of the rate of attenuation of light caused by fouling per unit area, and is a value $0\leq d\leq 1$.

Also, as illustrated in FIG. 9A, the amount Pi of light reflected is given by the following formula, where K is the reflectivity of the reference reflecting surface 76 and S is the irradiation surface area.

$$Pi=Pd\times K\times S\times d \quad (2)$$

Herein, the reflectivity K refers to a value defining the proportion of the amount Pi of reflected light relative to the amount Pd of irradiated light with which the reference reflecting surface 76 is irradiated.

Also, the photocurrent Ic is given by the following formula, where t is the scale factor of the phototransistor Pt (a circuit constant).

$$Ic=t\times Pi \quad (3)$$

This formula is indicative of the fact that the photocurrent Ic is reduced by a multiple when the sheet width sensor 48 is fouled and the amount Pi of light received is reduced. Also, the output voltage V0 is given by the following formula, where R is the resistance value of the resistor R2 (a pull-up resistor) of the light-receiving unit side.

$$Vo=Vcc-Ic\times R \quad (4)$$

When the sheet width sensor 48 is fouled, the amount Pi of light received is reduced, and the photocurrent Ic is reduced by a multiple, then the output voltage V0 will increase significantly.

Formula (4) given above is expressed by the formula below using the relational formulae (1) to (3) given above.

$$Vo=Vcc-Vcc\times(K\times S\times t\times D\times R/Rd)\times d2 \quad (4)$$

In the present embodiment, the resistance values Rd, R of the resistors R1, R2, respectively, are altered by the adjustment of the sensitivity of the sheet width sensor 48. The resistance values Rd, R of the resistors R1, R2, respectively, are expressed by an A-factor of an initial value Rd0 (Rd=A×Rd0) and a B-factor of an initial value R0 (R=B×R0), respectively, using rates of change A (where A>0) and B (where B>0) for the respective initial values Rd0, R0 thereof. From these relationships, the formula (4) given above is expressed by the following formula.

$$Vo=Vcc-Vcc\times(K\times S\times t\times D\times B\times R0/(A\times Rd0))\times d2 \quad (5)$$

Herein, because Vcc, K, S, t, D, R0, and Rd0 are constant values, the output voltage Vo is expressed by the following formula when the Vcc×(K×S×t×D×R0/Rd0) in formula (5) given above is taken as a mechanical parameter Mp (Mp1=Vcc×(K×S×t×D×R0/Rd0)).

$$Vo=Vcc-Mp\times B/A\times d2 \quad (6)$$

Herein, a ratio B/A of the rates of change A, B for the resistance values Rd, R of the resistors R1, R2 is taken as a resistance change rate ΔR(=B/A), and the square d2 of the fouling coefficient is taken as a fouling rate dc (where $0\leq dc\leq 1$). The resistance change rate=R(=B/A) expresses the scale factor of the sensitivity of the sheet width sensor 48 relative to the initial sensitivity (hereinafter also called the "sensitivity scale factor ΔR"). The fouling rate dc expresses the light amount attenuation rate caused by fouling on the light path from the emission of light to the receiving of light by the sheet width sensor 48. Herein, where the reference surface voltage Vs is defined as=Vcc−Vo, the reference surface voltage Vs is expressed by the following formula, using the relationship of the formula (6) given above.

$$Vs=Mp\times\Delta R\times dc \quad (7)$$

The graph illustrated in FIG. 9C illustrates the relationship between the reference surface voltage Vs and the position x of the sheet width sensor 48 in the movement direction on the reference reflecting surface 76. The reference surface voltage Vs, found by subtracting the output voltage V0 when the reference reflecting surface 76 is what is targeted for detection (=VL) from the power source voltage Vcc, is expressed by the product of the mechanical parameter Mp, the sensitivity scale factor ΔR, and the fouling rate dc. For this reason, the rate of change of the fouling rate dc can be represented as the rate of change of the reference surface voltage Vs.

As illustrated in FIG. 9C, the reference surface voltage Vs (=Vcc−Vo) will take a value that gradually decreases from the initial value Vs0 as the fouling of the sheet width sensor 48 increases (in other words, as the fouling rate dc decreases).

Further, because the adjusting of the amount of light emitted by the light-emitting unit 58 is implemented by changing the resistance value Rd of the resistor R1 and the adjusting of the sensitivity of the light-receiving unit 59 is implemented by changing the resistance value R of the resistor R2, the rate of change of the sensitivity scale factor ΔR can be represented as the rate of change of the reference surface voltage Vs.

In the initial state when the printer is shipped, the resistance value Rd=Rd0 and the resistance value R=R0, and thus the sensitivity scale factor ΔR=1. Also, the fouling rate dc takes a value dc=1 when there is no fouling and gradually decreases from "1" as the fouling increases. Where the fouling rate of the initial state is dc0=1, the initial value Vs0 of the reference surface voltage is given by the following formula.

$$Vs0=Mp \quad (8)$$

From the formulae (7), (8) given above, a ratio Vs/Vs0, which is the ratio of the reference surface voltage Vs and the initial value Vs0 thereof, is given by the following formula.

$$Vs/Vs0=\Delta R\times dc \quad (9)$$

In this manner, Vs/Vs0 changes in accordance with the sensitivity scale factor ΔR (=B/A), which is changed by the adjusting of the sensitivity of the sheet width sensor 48, and also changes in accordance with the fouling rate dc, which is changed by the fouling of the sheet width sensor 48. In other words, the ratio Vs/Vs0 is changed by the factors of change in fouling and by the factors of change in sensitivity. That is, the rate of change in the fouling rate dc of the sheet width sensor 48 and the rate of change in the sensitivity scale factor ΔR can also be detected inclusively as a unified ratio (the ratio Vs/Vs0). In the present embodiment, the reference surface voltage Vs is equivalent to one example of a measurement value, and the initial value Vs0 of the reference surface voltage is equivalent to one example of an initial value of the measurement value.

In order to realize this technique, a reflecting surface that serves as a reference for when the rate of change in fouling and the rate of change in sensitivity (resistance) are being detected is needed. In terms of constraints for this reference reflecting surface, it must be possible to avoid an event where: the reflectivity becomes very much higher than the initial value due to abrasion caused by the sliding of the sheet of paper P; or where the ink mist, the paper dust, or the like cause fouling and the reflectivity becomes very much lower than the initial value; which would cause the detection voltage to be saturated at an upper limit side or at a lower limit side; and the reflectivity must not be susceptible to fluctuation within the lifetime thereof. For this reason, in the present embodiment, as stated above, the top of the support base 75, which is of an intermediate height between the groove parts 71*a* and the upstream ribs 73, is employed as the reference reflecting surface 76.

Figure 10A:
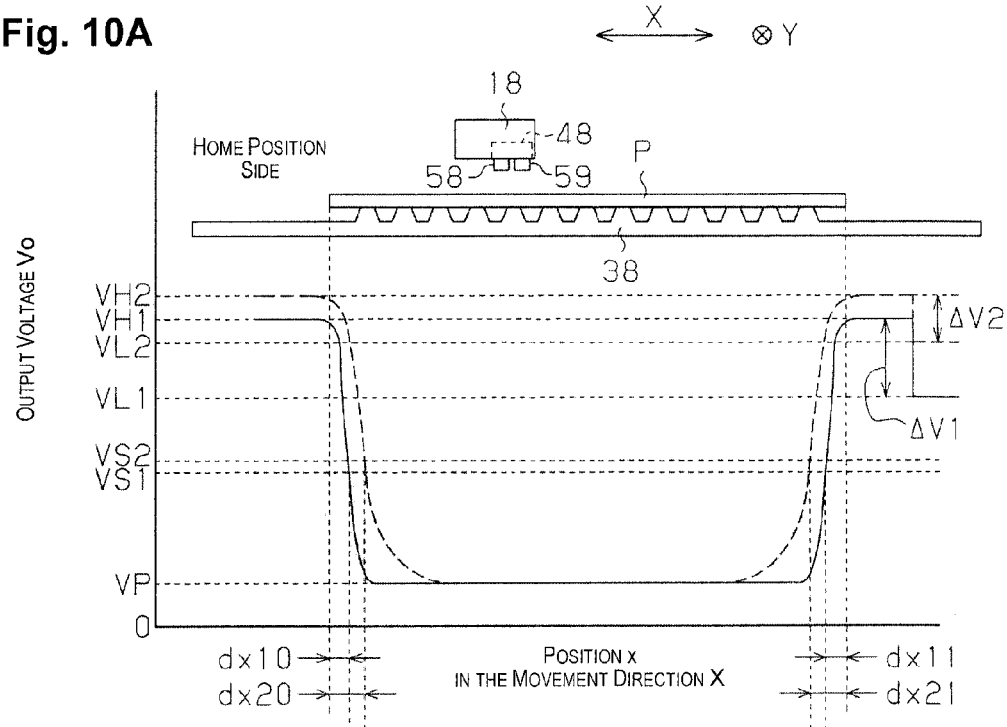
FIG. 10A is a graph illustrating the relationship between an output voltage and a position in a movement direction of a sheet width sensor.

The sensitivity switching performed when the degree of fouling of the sheet width sensor 48 is higher shall now be described, with reference to FIGS. 10A-10D. FIG. 10A illustrates the example of a case where the carriage 18 moves in the movement direction X and the edge of the sheet of paper P is detected by the sheet width sensor 48, in a state where the sheet of paper P has been conveyed as far as a position where the support base 38 (more specifically, the upstream support surface 71) is covered. The graph illustrated in FIG. 12A illustrates the relationship between the position x of the sheet width sensor 48 in the movement direction X (hereinafter also called the "sensor position x") and the output voltage V0 of the light-receiving unit 59. In this graph, the graph line illustrated by the solid line illustrates the relationship between the sensor position x and the output voltage V0 at an initial stage before the sheet width sensor 48 has been fouled, and the graph line illustrated by the dashed line illustrates the relationship between the sensor position x and the output voltage V0 at a point in time where the sheet width sensor 48 has been fouled from the initial state and has reached a degree of fouling of such an extent that the sensitivity thereof reaches the allowable sensitivity limit.

Figure 10B:
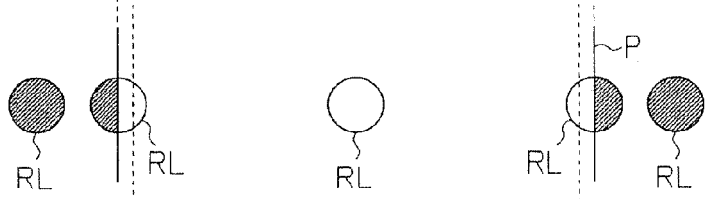
FIGS. 10B to 10D are schematic plan views illustrating the relationship between a sheet of paper and reflected light.
Figure 10C:
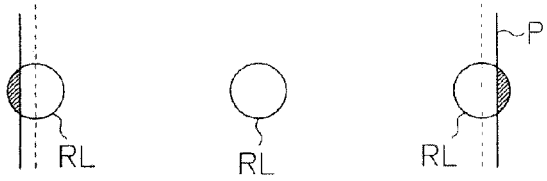
Figure 10D:
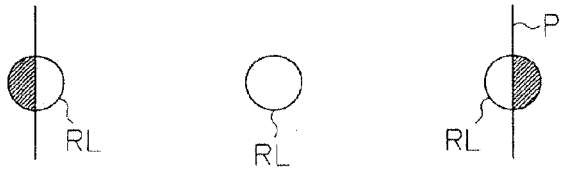

FIGS. 10B to 10D illustrate the manner in which a column of reflected light RL is reflected by the groove parts 71*a* or by the sheet of paper P before being received by the light-receiving unit 59 when the edge position of the sheet of paper P is being detected. Of the reflected light RL, these drawings use a dark grey color to indicate a dark region where a lesser amount of light is reflected by the groove parts 71*a*, and use a white color to indicate a bright region where a greater amount of light is reflected by the surface of the sheet of paper P. Herein, FIG. 10B is an illustration of when the sheet width sensor 48 is in an initial state, prior to fouling, at an initial first sensitivity, and FIG. 10C is an illustration of when the degree of fouling of the sheet width sensor 48 has reached the allowable limit of the first sensitivity. FIG. 10D illustrates a state of when there has been a switch from the first sensitivity to a second sensitivity. In FIGS. 10B to 10D, the edge of the sheet of paper P is indicative of the edge detection position, and is depicted as being shifted slightly inward from the actual edge of the sheet of paper P illustrated in FIG. 10A.

When the outside of the sheet of paper P is what is targeted to be detected, in FIG. 10B (when the reflected light RL is the dark grey color), a high output voltage VH1 is outputted from the light-receiving unit 59, which receives the reflected light RL where a lesser amount of light is reflected by the groove parts 71*a*. Then, when the region that is reflected by the sheet of paper P accounts for one half of the reflected light RL, then the output voltage V0 will become less than a threshold value VS1, which is ½ of the output voltage VH1, and a first edge of the sheet of paper P (the left-side end in FIG. 10B) is detected. Furthermore, in a section where the sheet of paper P is what is targeted to be detected, an output voltage VP (paper voltage) adequately smaller than the threshold value VS1 is outputted from the light-receiving unit 59, which receives the reflected light RL where a greater amount of light is reflected by the surface of the sheet of paper P. Then, when the region that is reflected by the sheet of paper P accounts for one half of the reflected light RL, then the output voltage V0 will become greater than the threshold value VS1, and a second edge of the sheet of paper P (the right-side end in FIG. 10B) is detected.

Thereafter, when the degree of fouling of the sheet width sensor 48 is higher, the amount of reflected light RL will become correspondingly smaller. For this reason, as illustrated in FIG. 10C, even when the region that is reflected by the sheet of paper P accounts for one half of the reflected light RL, the output voltage V0 will not fall below a threshold value VS2, but rather the output voltage V0 will first fall below the threshold value VS2 when the region that is reflected by the sheet of paper P accounts for close to 80% of the reflected light RL, as illustrated by the dashed line in FIG. 10A. For this reason, when the fouling of the sheet width sensor 48 progresses, the position where the edge of the sheet of paper P is detected shifts inward in the width direction of the sheet of paper P (i.e., in the movement direction X). The amount of this shift will be a detection error that is caused by the difference in the degree of fouling of the sheet width sensor 48.

An amount of positional deviation exists between the edge detection position where the edge of the sheet of paper P is detected and the actual position of the edge of the sheet of paper P. The amount of positional deviation varies depending on the degree of fouling of the sheet width sensor 48. In the present embodiment, the edge detection position of the sheet of paper P is corrected with the correction amount dx, which is equivalent to this amount of positional deviation. The non-volatile memory 54 stores table data TD (see FIG. 11) in which the relationship of correspondence between the ratio Vs/Vs0, found by dividing the reference surface voltage Vs (=Vcc−Vo) by the initial value Vs0 thereof, and the correction amount is set for different types of sheets of paper.

In the initial state where the degree of fouling is low, illustrated in FIG. 10B, the edge detection position of the sheet of paper P detected in response to when the output voltage V0 crosses over the threshold value VS1 is corrected with a correction amount dx1, acquired by consulting the table data TD on the basis of the ratio Vs/Vs0, to acquire the correct detection position of the edge of the sheet of paper P. In the state where the degree of fouling is high, illustrated in FIG. 10C, the edge detection position of the sheet of paper P detected in response to when the output voltage V0 crosses over the threshold value VS1 is corrected with a correction amount dx2, acquired by consulting the table data TD on the basis of the ratio Vs/Vs0, to acquire the correct edge position of the sheet of paper P. Herein, in the present example, the positional coordinates of the position in the movement direction X are set so that the direction from the home position toward the anti-home position becomes a positive direction. For this reason, correction amounts dx10, dx20 for cases where the detection position of the first edge on the home position side are to be corrected take negative values, and correction amounts dx11, dx21 for cases where the detection position of the second edge on the anti-home position side are to be corrected take positive values.

Meanwhile, in a sensitivity setting process, the carriage 18 is moved from the home position to a setting position at a predetermined timing, such as when the power source of the printer 11 is turned on or when the cumulative number of printed sheets reaches a setting number of sheets, and the output voltage VP outputted by the light-receiving unit 59 receiving the reflected light formed when the irradiated light from the light-emitting unit 58 is reflected by the reference reflecting surface 76 is acquired. Also, at a position where the sheet width sensor 48 faces the groove parts 71*a* while the carriage 18 is in the process of moving at this time, an output voltage VH outputted by the light-receiving unit 59 receiving the reflected light formed when the irradiated light from the light-emitting unit 58 is reflected by the groove parts 71*a* is acquired. The sensitivity adjustment unit 64 determines a sensitivity determination value to be a difference ΔV between the output voltage VH and the output voltage VL (=VH−VL), and determines that the measurement sensitivity having decreased due to fouling has exceeded an allowable limit in response to when the sensitivity determination value ΔV becomes less than a setting value b and satisfies a sensitivity switching condition. Upon determining that ΔV<b holds true and that the measurement sensitivity has exceeded the allowable limit, the sensitivity adjustment unit 64 alters the setting value of the sensitivity setting circuit 60B and switches the sensitivity of the light-receiving unit 59 to a sensitivity that is one stage higher. In the present embodiment, the output voltage VL is equivalent to one example of a first output value, and the output voltage VH is equivalent to one example of a third output value. Also, ΔV is equivalent to one example of a measurement sensitivity.

In the initial state where the degree of fouling is low, as illustrated in FIG. 10B, and while the degree of fouling is not greater than the allowable limit, a difference ΔV1 between an output voltage VH1 and an output voltage VL1 will be the setting value b or greater (ΔV1≥b), as illustrated in FIG. 10A). However, when the degree of fouling exceeds the allowable limit, as illustrated in FIG. 10C, a difference ΔV2 between an output voltage VH2 and an output voltage VL2 will become less than the setting value b (ΔV2<b), as illustrated in FIG. 10A. At a point in time where, due to the sensitivity of the light-receiving unit 59 having been switched to a sensitivity that is one stage higher, the region of reflected light that is reflected by the sheet of paper P accounts for one half of the reflected light RL, as illustrated in FIG. 10D, the output voltage V0 will cross over the threshold value VS, and the edge of the sheet of paper P is detected.

Figures 11, 12:
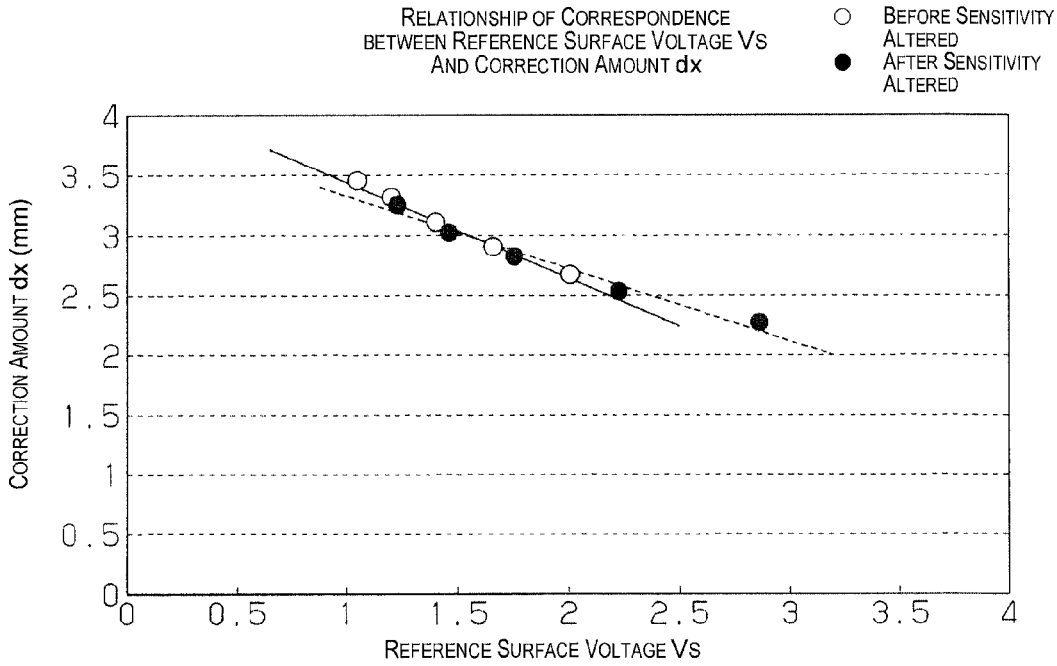
FIG. 11 is a schematic diagram illustrating table data.
FIG. 12 is a graph illustrating the relationship between a reference surface voltage Vs and a correction amount dx.

The correction amount setting unit 62 carries out a correction amount setting process, as one form of initial processing, when the printer 11 is powered on. FIG. 11 illustrates table data that is consulted by the correction amount setting unit 62 during the correction amount setting processing. The table data TD is meant to be indicative of the relationship of correspondence between the ratio Vs/Vs0 and the correction amount dx. Herein, the correction amount dx is found when the reflected light from the reference reflecting surface 76 is received by the light-receiving unit 59, the output voltage VL outputted from the light-receiving unit 59 is detected, and the amount of positional deviation between the actual edge of the sheet of paper P laid on the support base 38 and the edge detection position Xd of the sheet of paper P detected by the edge position detection unit 65 in FIG. 3 is measured.

In the table data TD illustrated in FIG. 11, the relationship of correspondence between the ratio Vs/Vs0 and the correction amount dx is set for each type of sheet of paper P (for each paper type). In the example in FIG. 11, "plain paper" and "glossy paper" are included as paper types. It shall be readily understood that the number of paper types prepared for the table data TD may be three or greater.

The table data TD illustrated in FIG. 11 is stored in the non-volatile memory 54 as reference data. When the sheet width sensor 48 is arranged at a setting position and the output voltage VL outputted by the light-receiving unit 59 having received the reflected light from the reference reflecting surface 76 is acquired, the correction amount setting unit 62 subtracts the output voltage VL from the power source voltage Vcc to calculate the reference surface voltage Vs (=Vcc−VL). The correction amount setting unit 62 also calculates the ratio Vs/Vs0 by using the initial value Vs0, and consults the table data TD to find the correction amount dx corresponding to the ratio Vs/Vs0. At this time, in a case where the ratio Vs/Vs0 does not exist in the table data TD, the correction amount setting unit 62 finds the correction amount by running an interpolation calculation using two correction amounts that correspond to the two ratios Vs/Vs0 sandwiching this ratio Vs/Vs0. Even when the sensitivity is switched, a single, common set of table data TD is used both before and after.

The table data shall now be described herein. The graph in FIG. 12 illustrates the relationship of correspondence between the reference surface voltage Vs and the correction amount dx. The white circles and the black circles illustrate the relationship of correspondence between the reference surface voltage Vs and the correction amount dx before the sensitivity is altered and after the sensitivity is altered, respectively. The points (○) before the sensitivity is altered, illustrated by the white circles, are arranged side by side along a substantially straight line, as illustrated by the solid line, while the points (●) after the sensitivity is altered, illustrated by the black circles, are arranged side by side along a substantially straight line, as illustrated by the dashed line. As will be understood from the graph in FIG. 12, the straight line along which the point group of white circles is arranged side by side (the solid line) and the solid line along which the point group of black circles are arranged side by side (the dashed line) have different slopes and intercept. For this reason, where provisionally the configuration employed were to be one for finding the correction amount dx that corresponds to the reference surface voltage Vs, the table data that is consulted would need to be switched before and after the sensitivity is switched.

Figure 13:
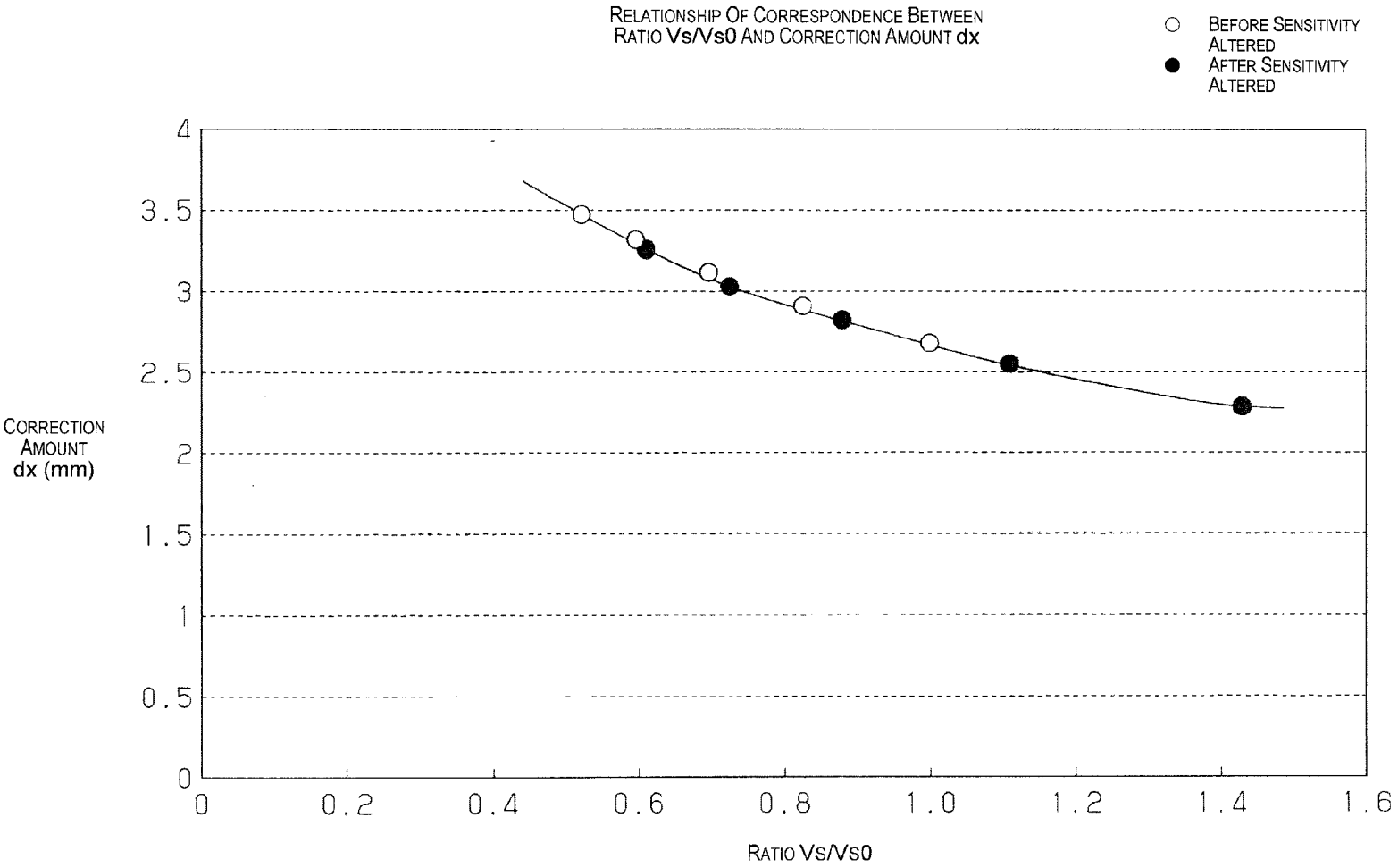
FIG. 13 is a graph illustrating the relationship between a ratio Vs/Vs0 and a correction amount dx.

The graph in FIG. 13 is for illustrating the relationship of correspondence between the ratio Vs/Vs0 and the correction amount dx. As will be understood from this graph, the point group for the correction amount dx that corresponds to the ratio Vs/Vs0 before the sensitivity is altered (the white circles) and the point group for the correction amount dx that corresponds to the ratio Vs/Vs0 after the sensitivity is altered (the black circles) are arranged side by side along the same curve. Accordingly, the correction amount setting unit 62 of the present embodiment finds the correction amount dx that corresponds to the ratio Vs/Vs0 by consulting the same table data TD illustrated in FIG. 11, even when the amount of light emitted and the sensitivity of the light-receiving unit 59 of the sheet width sensor 48 have been altered and the sensitivity of the sheet width sensor 48 has been switched. For this reason, there is no need to provide reference data for setting the correction amount for each of the different sensitivities of the sheet width sensor 48, nor is there a need to alter the reference data that is to be consulted every time the sensitivity is switched.

Figure 14:
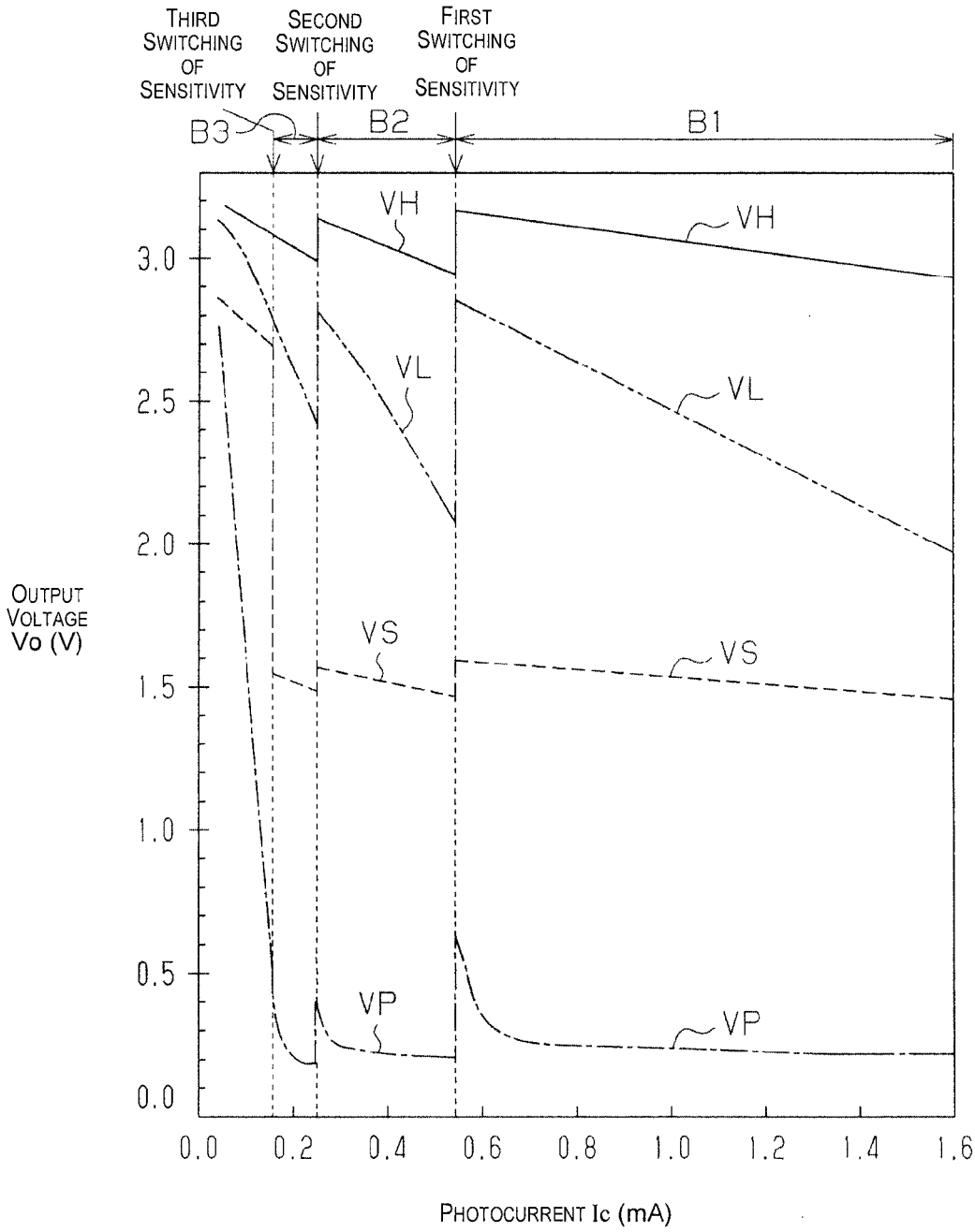
FIG. 14 is a graph illustrating the relationship between a photocurrent and an output voltage, and describing switching of the sensitivity.

The graph illustrated in FIG. 14 is for describing a process for applying the control signal to the terminal unit 79 of the sensitivity switching circuit 69 in FIG. 8 and switching the sensitivity of the light-receiving unit 59. The horizontal axis in this graph is the photocurrent Ic, and the vertical axis is the output voltage V0. The output voltage VH illustrated with the solid line in FIG. 13 is an output voltage that is outputted by the light-receiving unit 59 receiving the reflected light formed when the irradiated light from the light-emitting unit 58 is reflected by the groove parts 71*a*. The output voltage VP illustrated with the one-dot chain line is an output voltage outputted by the light-receiving unit 59 receiving the reflected light formed when the irradiated light from the light-emitting unit 58 is reflected by the sheet of paper P. The threshold value VS illustrated with the dashed line is set to be a value found by multiplying a predetermined constant a (where $0<a<1$) by the output voltage VH. In the present embodiment, the constant a is, for example, 0.5. The output voltage VL illustrated with the two-dot chain line is an output voltage outputted by the light-receiving unit 59 receiving the reflected light formed when the reference reflecting surface 76, illustrated in FIGS. 4, 6, 9, and the like is irradiated with light from the light-emitting unit 58 and this light is reflected by the reference reflecting surface 76.

As the ink mist, paper dust, and the like attaches to the sheet width sensor 48 and the degree of fouling becomes increasingly higher, the photocurrent Ic decreases. Then, as will be understood from the graph illustrated in FIG. 14, as the photocurrent Ic decreases, the output voltage VH at which the groove parts 71*a* are detected and the output voltage VL at which the reference reflecting surface 76 is detected gradually increase at predetermined slopes (gradients). At this time, the slope of the output voltage VL is at a greater angle (steeper gradient) than that of the slope of the output voltage VH, and thus as the degree of fouling increases, the sensitivity determination value ΔV (=VH−VL) gradually decreases. The setting value b for determining the allowable limit of the sensitivity of the light-receiving unit 59 is set to a value equivalent to the difference ΔV at a point in time where the output voltage VP (paper voltage) by which the sheet of paper P is detected is first elevated from a substantially constant value and reaches a predetermined value sufficiently smaller than the threshold value VS.

In the graph in FIG. 14, the dashed line extending in the longitudinal direction illustrates the sensitivity switching position at which the sensitivity of the light-receiving unit 59 is switched. In a region where the output voltage VP, having sharply increased, takes a value equivalent to or greater than the threshold value VS, the output voltage VP will take a value equivalent to or greater than the threshold value VS at all times, and therefore the edge of the sheet of paper P can no longer be detected. For this reason, in a range of the photocurrent IC where the output voltage VP, having begun to increase sharply, becomes a value sufficiently smaller than the threshold value VS, the light-receiving unit 59 is used at the same sensitivity, and when the photocurrent Ic becomes smaller than this range, the sensitivity of the light-receiving unit 59 is switched toward being one stage higher, thereby making it possible to detect the edge of the sheet of paper P. When the sensitivity determination value ΔV (=VH−VL) becomes smaller than the setting value b (ΔV<b), the sensitivity of the light-receiving unit 59 of the sheet width sensor 48 is switched toward being one stage higher. For this reason, the sheet width sensor 48 can be used in a range of sensitivity where the output voltage VP takes a value that is sufficiently smaller than the threshold value VS.

Herein, the sensitivity that is used in a range B1 of the photocurrent Ic until when the sensitivity is switched for the first time, the sensitivity that is used in a range B2 of the photocurrent Ic after the sensitivity has been switched for the first time until when the sensitivity is switched for a second time, and the sensitivity that is used after the sensitivity has been switched from the second time until when the sensitivity is switched for a third time are the initially set first sensitivity, a second sensitivity, and a third sensitivity, respectively. The minimal photocurrent Ic in the range B2 of the photocurrent is smaller than the minimal photocurrent Ic in the range B1 of the photocurrent. Further, the minimal photocurrent Ic in the range B3 of the photocurrent is smaller than the minimal photocurrent Ic in the range B2 of the photocurrent.

Switching the sensitivity in this manner makes it possible to broaden the range of the photocurrent Ic where the output voltage VP for detecting the sheet of paper P reaches a value sufficiently smaller than the threshold value VS (i.e., the range of the degree of fouling), toward the side where the photocurrent Ic becomes smaller (i.e., toward the side where the degree of fouling becomes greater), even when the degree of fouling of the sheet width sensor 48 becomes higher and there is a decline in the photoelectric current Ic of the light-receiving unit 59. For this reason, it is possible to broaden the range where the output voltage VP outputted from the light-receiving unit 59 and the threshold value VS can be compared to detect the edge of the sheet of paper P. In the present embodiment, when the sensitivity determination value ΔV becomes smaller than the setting value b (ΔV<b) while the sensitivity of the light-receiving unit 59 is the final third sensitivity, then the control unit 50 alters the setting value of the emitted light amount setting circuit (not shown) and switches the amount of light emitted by the light-emitting unit 58 toward being one stage greater. The reason for following such a procedure, where first the sensitivity of the light-receiving unit 59 is switched in a plurality of stages and, after the switching of the sensitivity has been entirely concluded, the amount of light emitted by the light-emitting unit 58 is then switched, is in order to avoid as much as possible an increase in the power consumed caused by increasing the amount of light emitted by the light-emitting unit 58.

Figure 15:
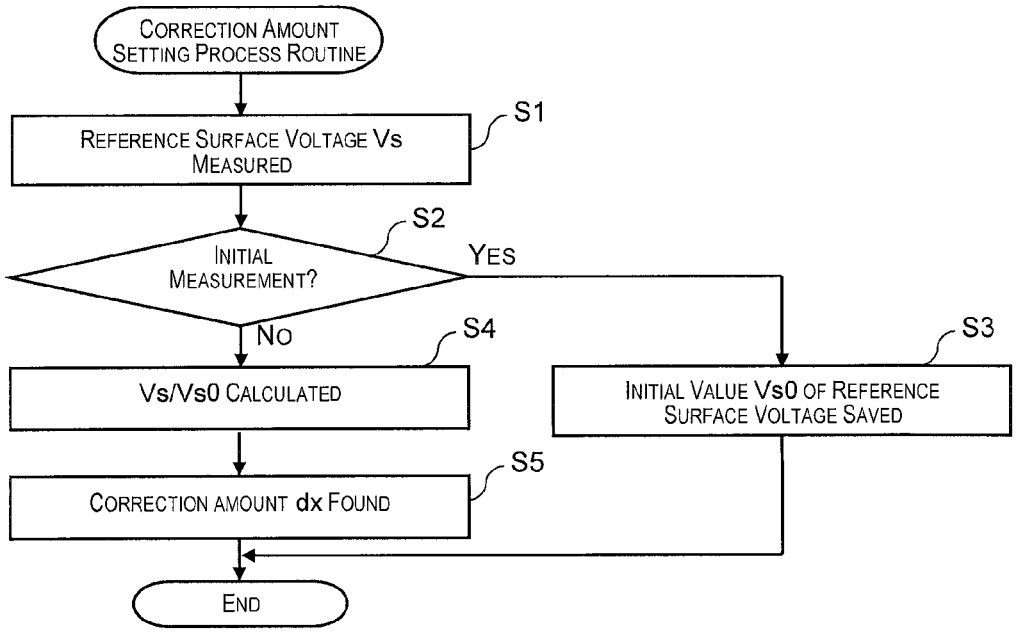
FIG. 15 is a flow chart illustrating a correction amount setting process routine.

The operation of the printer 11 of the present embodiment shall now be described with reference to the flow charts illustrated in FIGS. 15 to 17. Firstly, the correction amount setting process routine illustrated in FIG. 15 shall be described. When a predetermined timing is reached during the start-up of the printer 11, the correction amount setting unit 62 executes the correction amount setting processing. In the present embodiment, the correction amount setting unit 62 executes the correction amount setting processing as one form of initial processing that is executed, for example, when the printer 11 is powered on.

In step S1, the reference surface voltage Vs is measured. More specifically, the carriage motor 35 is driven and the carriage 18 is moved until the carriage arrives at the setting position where the sheet width sensor 48 faces the reference reflecting surface 76. The position of the carriage 18 in the movement direction X, which is based on the count of the counter for counting the number of edges of the input pulse from the linear encoder 39, is detected. When the carriage 18 arrives at the setting position and the count of the counter reaches a setting value that is equivalent to the setting position, the output voltage V0 (i.e., VL) outputted by the light-receiving unit 59 receiving the light reflected by the reference reflecting surface 76 is acquired, and Vcc−Vo is calculated to acquire the reference surface voltage Vs.

In step S2, the question of whether or not this is the initial measurement is determined. That is, the question of whether or not the reference surface voltage is being measured in step S1 for the first time when the printer 11 has been purchased and is being powered on for the first time is determined. In a case where this is the initial measurement (an affirmative determination in S2), the flow proceeds to step S3, and in a case where this is not the initial measurement, the flow proceeds to step S4.

In step S3, the reference surface voltage Vs thus measured is saved as the initial value Vs0 of the reference surface voltage. The initial value Vs0 is stored in a predetermined storage region of the non-volatile memory 54, as one example of a storage unit. Thereafter, when this is the initial measurement, the routine is concluded.

However, in a case where this is not the initial measurement (i.e., where this is the second or later iteration of measurement), the ratio Vs/Vs0 is calculated in step S4. When the degree of fouling of the sheet width sensor 48 is very low, the ratio Vs/Vs0 is Vs/Vs0≈1 (where Vs/Vs0≤1), and as the fouling of the sheet width sensor 48 progresses beyond the initial stage, the ratio Vs/Vs0 will gradually decrease while also becoming a value less than 1.

In the next step S5, the correction amount dx is found. More specifically, the correction amount setting unit 62 consults the table data TD and acquires the correction amount dx that corresponds to the ratio Vs/Vs0. When, in this case, no value for the relevant ratio Vs/Vs0 exists in the table data TD, then a correction amount dx that corresponds to this ratio Vs/Vs0 is acquired by running an interpolation calculation using the values on both sides sandwiching this ratio Vs/Vs0 (the values of the two neighboring ratios Vs/Vs0). It shall be readily understood that a calculation formula can also be employed as the reference data; in such a case, the correction amount dx is calculated by plugging in the value of the ratio Vs/Vs0 as a variable x for a calculation formula x=f(x) stored in the non-volatile memory 54 in order to calculate the correction amount dx. The correction amount setting unit 62 saves (stores) the correction amount dx thus found in the predetermined storage region of the non-volatile memory 54. The correction amount dx thus saved is used when the edge position correction unit 66 corrects the position of the edge detected by the edge position detection unit 65 when the position of the edge of the sheet of paper P is being detected.

The paper edge position detection processing for detecting the position of the edge of the sheet of paper P shall now be described, with reference to FIGS. 16 and 17. The control unit 50 executes a program for the paper edge position detection process routine illustrated by the flow chart in FIG. 16 and the sensitivity setting process routine illustrated in FIG. 15, equivalent to a sub-routine thereof. In an initial state where the printer 11 is powered up for the first time after purchase, the sensitivity of the light-receiving unit 59 is at the first sensitivity. The first sensitivity is a relatively low sensitivity, and thus erroneous detection arising due to the sensitivity of the light-receiving unit 59 being too high is minimized.

In step S11, the sensitivity setting processing is carried out. That is, the sensitivity adjustment unit 64 inside the control unit 50 sets the sensitivity of the sheet width sensor 48. In the present embodiment, the sensitivity adjustment unit 64 carries out the sensitivity setting processing at, for example, a point in time where the user operates the power source switch 23 and the power source of the printer 11 is turned on, and at a point in time where the cumulative number of sheets printed reaches a setting number of sheets (a setting value) during start-up of the printer 11. The sensitivity setting processing shall be described in greater detail below.

In the next step S12, the carriage 18 is moved so as to reach a position where the sheet width sensor 48 faces the upstream support surface 71. More specifically, the control unit 50 drives the carriage motor 35 and moves the carriage 18 so as to reach a position where the sheet width sensor 48 faces the groove parts 71*a* of the upstream support surface 71. The movement of the carriage 18 at this time may make concomitant use of the movement of the carriage 18 for during the sensitivity setting processing in step S1.

In step S3, the output voltage VH of the sheet width sensor 48 caused by the reflected light from the groove parts 71*a* of the upstream support surface 71 is acquired. In step S14, the threshold value VS is set. That is, the threshold value VS is set to VS=a·VH. In the present embodiment, a=0.5 is employed as one example, but the constant a can also employ a suitable value within the range 0<a<1.

In the next step S15, the sheet of paper P is conveyed to a position where the upstream support surface 71 is covered, and the carriage 18 is moved. The control unit 50 initiates the driving of the carriage motor 35 at a timing where, for example, a leading end of the sheet of paper P crosses over the movement path of the sheet width sensor 48 in plan view, and causes the carriage 18 to move from the home position toward the anti-home position. At this time, the carriage 18 moves so that the sheet width sensor 48 passes through both ends of the sheet of paper P in the width direction.

In step S16, the output voltage V0 outputted from the light-receiving unit 59 of the sheet width sensor 48 is acquired. That is, the output voltage V0 of the sheet width sensor 48 while the carriage 18 is moving is acquired in a successive fashion.

In the next step S17, a determination is made as to whether or not the output voltage V0 has crossed over the threshold value VS. In other words, the edge detection unit 63 determines whether or not the output voltage V0 has become less than the threshold value VS, or whether or not the output voltage has become greater than the threshold value VS. In a case where the output voltage V0 did not cross over the threshold value VS, the flow returns to step S15, and the movement of the carriage 18 is continued. Then, the processes for steps S15 and S16 are carried out at every predetermined cycle time (for example, a predetermined time lasting in the range of 10 microseconds to 100 milliseconds) while the carriage 18 is being moved, until the determination in step S17 becomes affirmative. The flow proceeds to step S18 when the output voltage V0 is determined in step S17 to have crossed over the threshold value VS. The conveyance of the sheet of paper in step S15 is stopped once the sheet of paper P has reached at a predetermined position where the upstream support surface 71 is covered.

In step S18, the edge detection position Xd of the sheet of paper P is acquired. In the present embodiment, the position of the sheet width sensor 48, i.e., the edge detection position Xd of the sheet of paper P is calculated by using the position of the carriage 18 ascertained from the count of the counter when the output voltage VP crossed over the threshold value VS, and the known distance between the position of the carriage 18 and the attachment position of the sheet width sensor 48.

In step S19, the edge position Xe is acquired by correcting the edge detection position Xd with the correction amount dx (Xe=Xd+dx). That is, the predetermined storage region of the non-volatile memory 54 stores the correction amount dx that was found in the correction amount setting process (FIG. 15) executed when the printer 11 was powered on. The edge position correction unit 66 calculates the edge position Xe of the sheet of paper P by reading out the correction amount dx from the predetermined storage region of the non-volatile memory 54 and correcting the edge detection position Xd of the sheet of paper P on the basis of the correction amount dx (Xe=Xd+dx). The edge position correction unit 66 reads from the predetermined storage region of the non-volatile memory 54 the correction amount dx that corresponds to the edge of the sheet of paper P that is detected at that time, from among the first edge and the second edge, and acquires the edge position Xe of the sheet of paper P by correcting the edge detection position Xd with this correction amount dx. When the edge position Xe of the first edge is acquired in step S19, the processes in steps S15 to S19 are thereafter also carried out in a similar manner for the second edge, and the edge position Xe of the second edge is acquired in step S9.

In this manner, a correction using the correction amount dx corresponding to the sensitivity of the sheet width sensor 48 as determined from the degree of fouling at that time is implemented, even though the degree of fouling of the sheet width sensor 48 may have increased, reducing the amount of light received by the light-receiving unit 59 and causing changes in the amount of widthwise positional deviation between the edge detection position Xd of the sheet of paper P and the actual edge position of the sheet of paper P. As a result, it is possible to detect the edge position Xe of the sheet of paper in a relatively more exact fashion.

The sensitivity setting process routine for step S11 shall now be described in greater detail. The sensitivity setting processing is carried out in a state where the upstream support surface 71 is not covered by the sheet of paper P. First, in step S21, the carriage 18 is moved so as to reach a position where the sheet width sensor 48 faces the upstream support surface 71. That is, the control unit 50 drives the carriage motor 35, and moves the carriage 18, for example, from the home position toward the anti-home position. The control unit 50 actuates the sheet width sensor 48 while the carriage 18 is in the process of moving.

In step S22, the output voltage VH of the sheet width sensor 48 caused by the reflected light from the groove parts 71*a* of the upstream support surface 71 is acquired. For example, the output voltage VH when the sheet width sensor 48 is at a position facing the groove parts 71*a* while the carriage 18 is in motion is acquired. A plurality of output voltages VH may also be acquired, for example, at different positions of the carriage 18, with the mean value thereof serving as the output voltage VH. It shall be readily understood that the output voltage VH may also be acquired in a state where the carriage 18 has been stopped at a position where the sheet width sensor 48 faces the groove parts 71*a*.

In the next step S23, the carriage 18 is moved to the setting position. When, for example, the acquisition of the output voltage (S12) is finished in the midst of the process of moving the carriage 18 from the home position toward the anti-home position in step S11, then the movement of the carriage 18 is continued without alteration and the carriage 18 is moved to the setting position.

In step S24, the output voltage VL of the sheet width sensor 48 caused by the reflected light from the reference reflecting surface 76 is acquired. When the carriage 18 has arrived and stopped at the setting position, the sheet width sensor 48 is in a state of facing the reference reflecting surface 76. The sensitivity adjustment unit 64 acquires the output voltage VL of the sheet width sensor 48 when the carriage 18 stops at the setting position.

In step S25, the sensitivity determination value VH−VL is calculated. In other words, the sensitivity determination value ΔV (=VH−VL) is calculated. In the next step S26, a determination is made as regards the degradation of the sheet width sensor 48 (the fouling is determined). More specifically, the sensitivity adjustment unit 64 determines whether or not the sensitivity determination value ΔV (=VH−VL), which is indicated by the difference between the output voltage VH and the output voltage VL, is less than the setting value b (ΔV<b). The routine ends without switching of the sensitivity of the sheet width sensor 48 when ΔV<b does not hold true and the sensitivity of the sheet width sensor 48 has not declined to the extent where the sensitivity needs to be switched. In turn, the flow proceeds to step S27 when ΔV<b does hold true and the sensitivity of the sheet width sensor 48 is determined to have declined to the extent where the sensitivity needs to be switched. In the present embodiment, the CPU 51 for executing the determination process of this step S26 constitutes one example of a determination unit for determining whether or not a sensitivity has gone beyond an allowable limit value.

In step S27, the sensitivity of the sheet width sensor 48 is switched. That is, the sensitivity adjustment unit 64 switches the sensitivity of the light-receiving unit 59 of the sheet width sensor 48 to a sensitivity that is one stage higher, by altering the setting value of the sensitivity setting circuit 60B and altering the control signal (PWM signal) that is outputted to the sensitivity setting circuit 60B to a duty ratio corresponding to the altered setting value. In this manner, as illustrated in FIG. 13, the sensitivity of the sheet width sensor 48 is switched to a sensitivity that is one stage higher every time the sensitivity setting value ΔV (=VH−VL) becomes less than the setting value b (ΔV<b). As a result, it is possible to switch the sensitivity of the sheet width sensor 48 at the proper timing in the progression of the fouling.

In the present embodiment, the correction amount dx that corresponds to the ratio Vs/Vs0 is set by the correction amount setting unit 62 using the same table data TD even though the sensitivity of the sheet width sensor 48 has been switched.

As has been described above, in the present embodiment, the effects illustrated below can be obtained.

(1) The voltage Vs found by subtracting the output voltage VL of when the reference reflecting surface 76 was detected from the power source voltage Vcc is divided by the initial value Vs0 thereof to find the ratio Vs/Vs0 and the table data TD, indicative of the relationship of correspondence between the ratio Vs/Vs0 and the correction amount (the amount of positional deviation), is consulted to acquire the correction amount dx that corresponds to the ratio Vs/Vs0. The edge position of the sheet of paper P is acquired by using the correction amount dx to correct the edge detection position Xd of the sheet of paper P detected by the comparison between the output voltage VP and the threshold value VS. For this reason, it is possible to detect the edge position Xe of the sheet of paper P in a relatively more accurate fashion in comparison to a configuration where the threshold value is set on the basis of the ratio between the detection voltages of the ribs of the support base and a portion other than the ribs (the grooves), as in the techniques described in, for example, Patent Documents 2 and 3.

(2) The correction amount dx can be acquired using the same table data TD on the basis of the ratio Vs/Vs0, both before and after the sensitivity of the sheet width sensor 48 has been switched. In other words, there is no need to switch the table data TD that is to be used before or after the sensitivity of the sheet width sensor 48 is switched. Accordingly, even when the sensitivity has been switched, a correction amount dx that is appropriate when the same processing using the same table data TD as before the sensitivity is switched is carried out can be acquired.

(3) The ratio Vs/Vs0, expressed by Vs/Vs0=ΔR×dc from the relationship where the reference surface voltage Vs=MP×ΔR×dc, is indicated by the product of ΔR (the sensitivity scale factor), which is a parameter for adjusting the sensitivity, and the fouling rate dc (the attenuation rate of the light amount), which is a parameter of fouling. For this reason, there need be only one set of the table data TD indicative of the relationship of correspondence between the ratio Vs/Vs0 and the correction amount dx, even when the fouling of the sheet width sensor 48 has progressed and either the sensitivity has been switched or the fouling rate has changed, and the same table data TD can be consulted to acquire the correction amount dx that corresponds to the ratio Vs/Vs0 at the time.

(4) Because the configuration is one where the table data TD is stored in the non-volatile memory 54 and the correction amount is acquired by consulting the table data TD on the basis of the ratio Vs/Vs0, there is no need to carry out a calculation process in a case where, for example, a linear approximation formula is used, except for the interpolation computation, and the correction amount dx can be acquired with a relatively simple process.

(5) The sensitivity of the sheet width sensor 48 is switched by giving priority to adjusting the sensitivity of the light-receiving unit 59 and, after the sensitivity of the light-receiving unit 59 has gone beyond the allowable limit, then adjusting the amount of light emitted by the light-emitting unit 58. It is accordingly possible to minimize the opportunity for usage that increases the amount of light emitted by the light-emitting unit 58 in the adjustment of the sensitivity, and thus possible to lengthen the lifetime of the light-emitting unit 58.

(6) The correction amount setting process is carried out when the power is turned on and when the cumulative number of sheets printed has reached a setting number of sheets, and thus the correction amount setting process will not be carried out very frequently. For this reason, the correction amount setting process is less likely to be the cause of a decline in print throughput.

Second Embodiment

Figure 18:
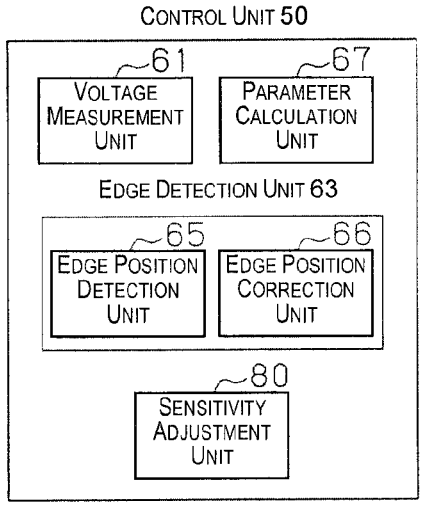
FIG. 18 is a block diagram illustrating a functional configuration of a control unit in a second embodiment.
Figure 19:
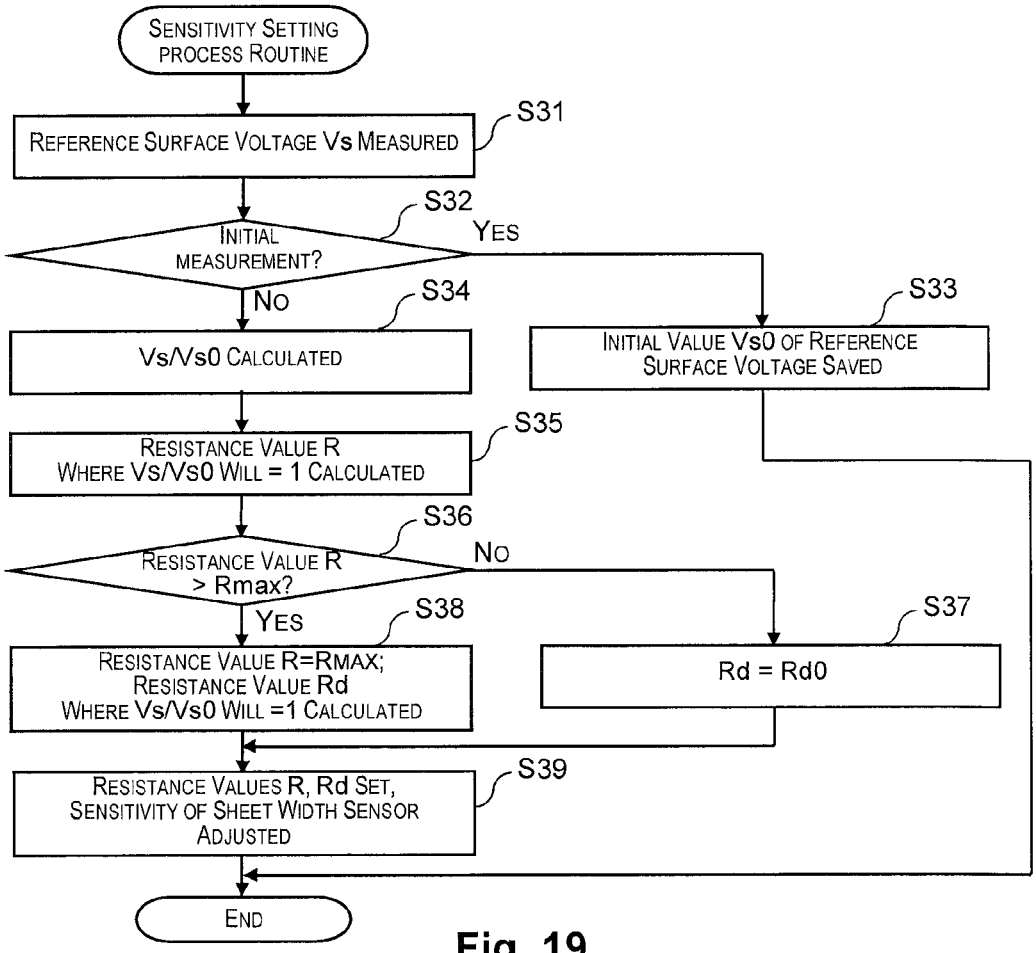
FIG. 19 is a flow chart illustrating a sensitivity setting process routine.

The following describes the second embodiment, on the basis of FIGS. 18 and 19. In the present embodiment, the sensitivity of the sheet width sensor 48 is adjusted so that the ratio Vs/Vs0 becomes Vs/Vs0=1.

As illustrated in FIG. 18, instead of the correction amount setting unit 62 in the first embodiment, a parameter calculation unit 67 serving as one example of a parameter acquisition unit is provided. A parameter of the present embodiment refers to a parameter for adjusting the sensitivity of the sheet width sensor 48 and, in the present example, specifically refers to the resistance values R, Rd of the resistors R1, R2. A sensitivity adjustment unit 80 inside the control unit 50 adjusts the sensitivity of the light-receiving unit 59 by setting a sensitivity setting value for the sensitivity switching circuit 69, outputting a control signal of, for example, a duty ratio that corresponds to the sensitivity setting value, and adjusting the resistance value R of the resistor R2. Herein, there are limitations to the sensitivities that can be handled with the adjustment of the resistance value R; the resistance value R, which is calculated as a parameter for adjusting the sensitivity, is used in handling the adjustment of the sensitivity of the light-receiving unit 59 only when within an allowable limit value Rmax, equivalent to an allowable limit of sensitivity. When the resistance value R calculated as the parameter for adjusting the sensitivity goes beyond the allowable limit value Rmax, then the resistance value R=Rmax, and once the resistance value R is understood to be Rmax, then the resistance value Rd of the resistor R1 needed in order to reach the needed sensitivity is calculated. The resistance value Rd is then adjusted to adjust the amount of light emitted by the light-emitting unit 58. The sensitivity of the sheet width sensor 48 is thus adjusted by giving priority to first adjusting the resistance value R of the resistor R2 inside the sensitivity setting circuit 60B on the light-receiving unit 59 side to adjust the sensitivity of the light-receiving unit 59 and, when the resistance value R goes beyond the allowable limit value Rmax and the sensitivity on the light-receiving unit 59 side goes beyond the allowable limit, then adjusting the resistance value Rd of the resistor R1 inside the emitted light amount setting circuit 60A on the light-emitting unit 58 side to adjust the amount of light emitted by the light-emitting unit 58.

Controlling the emitted light amount switching circuit 68 enables the sensitivity adjustment unit 64 of the present embodiment to continuously adjust the resistance value Rd of the resistor R1, and this makes it possible to continuously adjust the sensitivity of the sheet width sensor 48. Controlling the sensitivity switching circuit 69 enables the sensitivity adjustment unit 64 to continuously adjust the resistance value R of the resistor R2, and this makes it possible to continuously adjust the sensitivity of the sheet width sensor 48. Also, because the correction amount setting unit 62, which was present in the first embodiment, is not provided in the present embodiment, the table data TD is not stored in the non-volatile memory 54, and the correction amount setting unit 62 inside the control unit 50 does not execute the correction amount setting process illustrated in FIG. 15.

Figure 16:
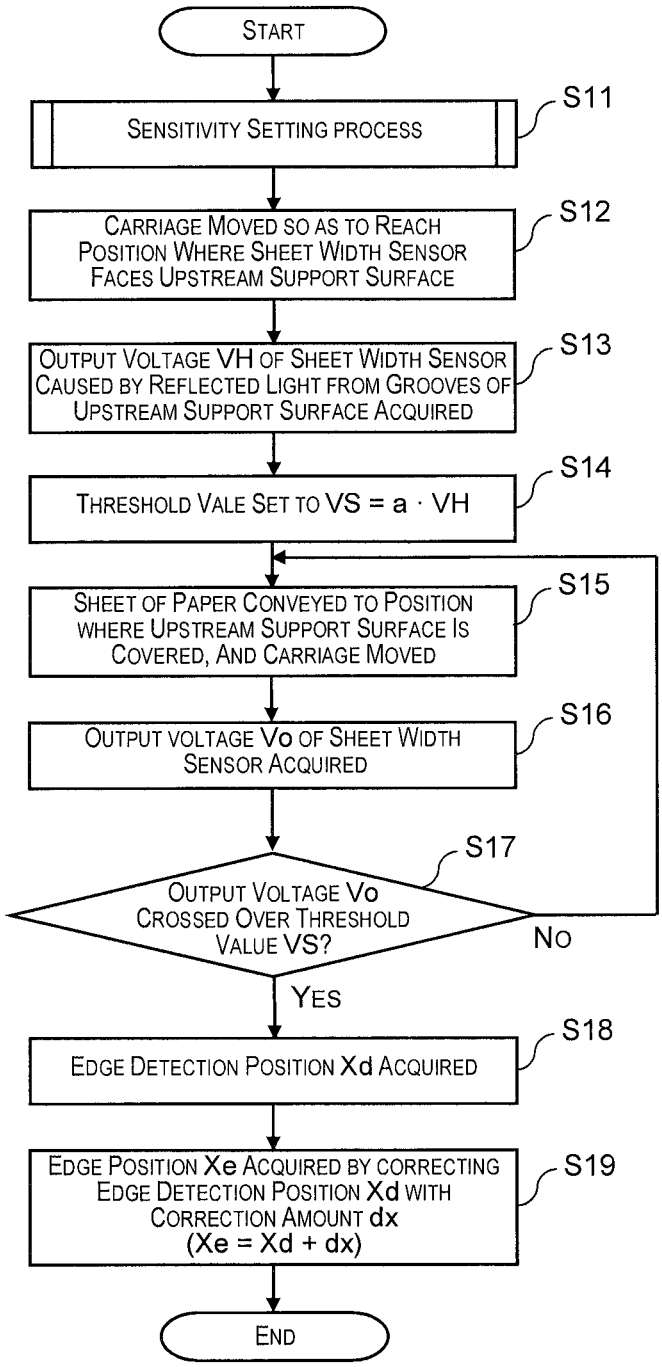
FIG. 16 is a flow chart illustrating an edge position detection process routine.
Figure 17:
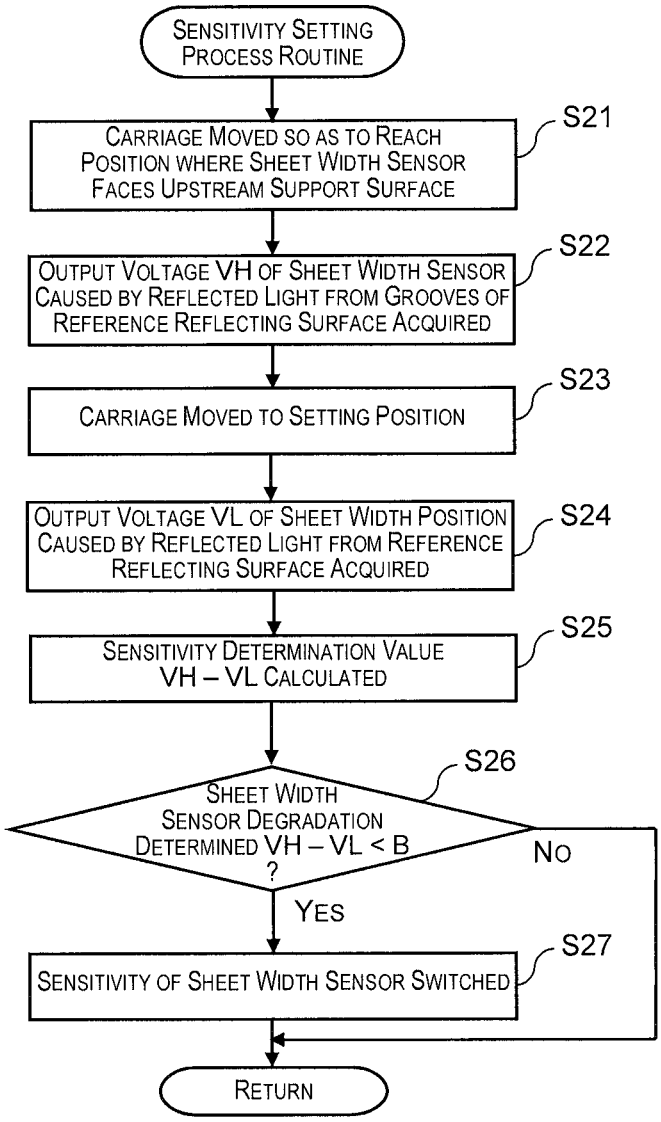
FIG. 17 is a flow chart illustrating a sensitivity setting process routine.

The following describes the operation of the printer 11 of the present embodiment, on the basis of FIGS. 16 and 19. In the present embodiment, similarly with respect to the first embodiment, the paper edge position detection process illustrated in FIG. 16 is executed. At this time, the content of the sensitivity setting process in step S11 is different; in the present embodiment, the sensitivity of the sheet width sensor 48 is set by executing the sensitivity setting process illustrated in FIG. 19. The paper edge position detection process in FIG. 16 is similar with respect to the first embodiment, and thus a more detailed description thereof is omitted; the following describes the sensitivity setting process of FIG. 19.

First, in step S31, the reference surface voltage Vs is measured. That is, the control unit 50 drives the carriage motor 35, moves the carriage 18 to the setting position, and stops the carriage at the setting position, in which state the output voltage V0 (i.e., output voltage VL) of the light-receiving unit 59 receiving the reflected light of the light with which the reference reflecting surface 76 is irradiated by the light-emitting unit 58 is acquired. Then, Vs=Vcc−Vo is calculated to acquire the reference surface voltage Vs.

In step S32, the question of whether or not this is the initial measurement is determined. That is, the question of whether or not the reference surface voltage is being measured in step S1 for the first time when the printer 11 has been purchased and is being powered on for the first time is determined. In a case where this is the initial measurement (an affirmative determination in S2), the flow proceeds to step S33, and in a case where this is not the initial measurement, the flow proceeds to step S34.

In step S33, the reference surface voltage Vs thus measured is saved as the initial value Vs0 of the reference surface voltage. The initial value Vs0 is stored in, for example, the predetermined storage region of the non-volatile memory 54. However, in a case where this is not the initial measurement (i.e., where this is the second or later iteration of measurement), the ratio Vs/Vs0 is calculated in step S34. When the degree of fouling of the sheet width sensor 48 is very low, the ratio Vs/Vs0 is Vs/Vs0≈1 (where Vs/Vs0≤1), and as the fouling of the sheet width sensor 48 progresses beyond the initial stage, the ratio Vs/Vs0 will gradually decrease while also becoming a value less than 1. Each of the processes in steps S31 to S34 thus far is the same of the processes of steps S1 to S4, respectively, in FIG. 15 of the first embodiment.

In the next step S35, a resistance value R whereby the ratio Vs/V0 would become Vs/Vs0=1 is calculated. More specifically, the resistance value R is calculated by calculating the inverse of the ratio Vs/Vs0 to find a constant N and then multiplying the resistance value Ro by (R=N·Ro).

next step S36, a determination is made as to whether or not the resistance value R has gone beyond the allowable limit value Rmax. The flow proceeds to step S37 when R>Rmax does not hold true (i.e., when R≤Rmax), whereas the flow proceeds to step S38 in a case where R>Rmax does hold true. In the present embodiment, the CPU 51 for executing the determination process in step S36 constitutes one example of a determination unit for determining whether or not a parameter has gone beyond an allowable limit value.

In step S37, the resistance value Rd of the resistor R1 is set to the initial value Rd0 thereof (Rd=Rd0). In step S38, the resistance value R is understood to=Rmax and a resistance value Rd whereby, under this condition, the ratio Vs/Vs0 would=1 is calculated. More specifically, the resistance value Rmax is represented as =Bmax×R0. Using the fact that ΔR=Bmax/A from the relationship in formula (9) given above, then Vs/Vs0=ΔR×dc=Bmax/A×dc, so an A that satisfies Bmax/A×dc=1 is calculated in order for Vs/Vs0 to =1. Accordingly, A is found to =Bmax×dc, and the resistance value Rd of the resistor R1 is understood to be Rd=Bmax×dc×Rd0.

The resistance values R, Rd, which are the parameters of the present example, are thus calculated by the parameter calculation unit 67 carrying out the processes of steps S34 to S38. In the next step S39, the resistance values R, Rd are set and the sensitivity of the sheet width sensor 48 is adjusted. That is, the sensitivity adjustment unit 80 outputs to the emitted light amount switching circuit 68 a control signal that corresponds to the resistance value Rd to set the resistor R1 to the resistance value Rd, and also outputs to the sensitivity switching circuit 69 a control signal that corresponds to the resistance value R to set the resistor R2 to the resistance value R. As a result, the light-emitting unit 58 is adjusted to an amount of emitted light that corresponds to the resistance value Rd, and the light-receiving unit 59 is adjusted to a sensitivity that corresponds to the resistance value R. The sensitivity of the sheet width sensor 48 is thus adjusted. The sensitivity at this time satisfies Vs/Vs0=1. In other words, the sensitivity is adjusted to one where the reference surface voltage Vs takes the same value as the initial value Vs0 thereof.

Accordingly, even when the sheet width sensor 48 has been fouled, there will always be a constant amount of positional deviation from the actual edge position of the sheet of paper P for the edge detection position Xd (S18) of the sheet of paper P acquired when the output voltage V0 crosses over the threshold value VS in step S17 (an affirmative determination in S17) in the paper edge position detection process. For this reason, in step S19, the edge position Xe is acquired by correcting the edge detection position Xd with a constant, previously set correction amount dx (Xe=Xd+dx).

According to the second embodiment, the effects illustrated below can be obtained.

(7) A resistance value R whereby the ratio Vs/Vs0 would reach "1" is found, and the resistance value R thus found is set to adjust the sensitivity of the sheet width sensor 48. Accordingly, the correction amount dx used in the calculation of the edge position Xe from the edge detection position Xd can be set to be constant. For this reason, there is no need to prepare the table data TD, and thus the correction amount setting process can be forgone. Because of this, the paper edge position detection process can be made into a relatively simple process in comparison to a configuration, such as that of the first embodiment, where the correction amount dx changes in accordance with the degree of fouling.

(8) Priority is given to adjusting the sensitivity of the light-receiving unit 59 as long as the resistance value R is not greater than the allowable limit value Rmax and the sensitivity of the light-receiving unit 59 has not gone beyond the allowable limit. When the resistance value R goes beyond the allowable limit value Rmax and the sensitivity of the light-receiving unit 59 goes beyond the allowable limit, then the sensitivity adjustment of the light-emitting unit 58 is carried out. It is accordingly possible to lengthen the lifetime of the light-emitting unit 58.

The embodiments described above can also be altered to the following modes.

- A constant J(=Vs0/Vs) whereby the ratio Vs/Vs0 would reach "1" is calculated, and the output voltage V0 acquired from the sheet width sensor 48 when the edge position of the sheet of paper P is being detected is multiplied by J to correct to an output voltage Vr. The edge detection position Xd of when the corrected output voltage Vr crosses over the threshold value VS is then detected. In this configuration, too, the correction amount dx can be constant at all times, and thus the edge position Xe can be acquired when the edge detection position Xd is corrected with the constant correction amount dx. The ratio between Vs and Vs0 may be made to be a ratio Vs0/Vs, the inverse of the ratio Vs/Vs0.
- In the first embodiment, the table data TD was used, but it would also be possible to employ a method for storing in the non-volatile memory 54 a linear formula dx=m·(Vs/Vs0)+n (where m is a coefficient and n is a constant) that linearly approximates the plot points of the graph in FIG. 13 by a method known in the art, such as, for example, the least squares method, and plugging the value of the ratio Vs/Vs0 into this formula to calculate the correction amount dx. It shall be readily understood that the approximation formula is not limited to being a first-order expression of linear approximation, but rather may also be a second-order formula that approximates a curve.
- The initial value is not limited to being the second output voltage that is first to be measured (measured the first time). Provided that the second output voltage serves as a reference for when the correction information is being created and thereafter serves as a reference for examining the extent of fouling, there is no limitation to being the first time. For example, the mean value of the tenth through twentieth measured values may also serve as the initial value of the second output value.
- In the embodiments described above, the configuration was one where the sensitivity of the light-emitting unit was switched, but the configuration may also be one where a sensitivity switching function is not provided. In such a case, it would still be possible to acquire the correction amount in a relatively simple fashion, and thus the detection position of the medium could be acquired in a relatively simply fashion.

The parameter is not limited to being a resistance value. The parameter may be arbitrarily chosen, provided that the parameter make it possible to alter the sensitivity. The parameter may be, for example, a voltage value or an electric current value, the voltage value or electric current value then being altered to adjust the sensitivity.

The threshold value VS was set to =a·VH, but the method for setting the threshold value can be altered as appropriate. For example, a constant threshold value that is not proportionate to the output voltage VH may be set. Also, for example, a threshold value that corresponds to the ratio of each of the output voltages by which the groove parts and the ribs of the support base were detected by the optical sensor may be set, as is described in Patent Documents 2 and 3.

The reference reflecting surface 76 was arranged below a position through which the carriage 18 passes during printing, but the position of the reference reflecting surface 76 may also be a position on the outside of the liquid ejecting region PA in the movement direction X.

The reference reflecting surface is not limited to being adapted to be integrally formed on the support base, but rather may be adapted to rise when a cover is opened, in a direction drawing closer to the carriage from behind the lower side thereof. Also, the reference reflecting surface is not limited to being arranged at a position at which the reference reflecting surface can face in the same direction as the direction in which the sheet width sensor faces the sheet of paper or other medium. For example, the sheet width sensor may be provided to the carriage 18 so that the angle can be changed, and a reference reflecting surface which is a vertical plane may then be provided to a position other than the support base, e.g., on a side wall surface of a body frame of the printer. In such a case, the orientation of the sheet width sensor should be altered to acquire the output voltage VL of the light-receiving unit receiving the reflected light from the reference reflecting surface.

The timing for implementing the sensitivity setting processing is not limited to the timing when the power is turned on and the like, but rather may also be during printing. For example, the sensitivity setting processing may be carried out during paper feeding/discharging, when the page being printed is switched, or during a flushing in which the carriage is moved to the edge of the movement path to eject ink into a liquid drain unit for the purpose of maintaining the nozzles of the liquid ejecting head. The sensitivity setting processing may also be carried out during an end process when the power is turned off. The sensitivity setting process may additionally be carried out every time the cumulative duration of printing reaches a setting duration.

The optical sensor for detecting the widthwise edge position of the medium is not limited to being a sheet width sensor the purpose of which is to acquire the sheet width or is to determine an ejection start position (print start position) in the movement direction X (main scanning direction) of the liquid ejecting head 19. For example, the optical sensor may be intended merely to acquire the edge position of the medium in the width direction. The optical sensor may also be intended to detect the skew (slant) of the medium. The purpose of the optical sensor may additionally be to detect the edge of the medium in the conveyance direction. In such a case, the carriage is arranged in a conveyance area prior to conveyance of the medium, and thereafter the medium is conveyed so as to pass below the carriage, whereby the edge of the medium in the conveyance direction is detected by the optical sensor.

The detection circuit of the sheet width sensor 48 was a circuit configuration in which the output voltage V0 is smaller when a greater amount of light is received by the light-receiving unit 59 and in which the output voltage V0 is greater when a lesser amount of light is received; however, in a reversal therefrom, a circuit configuration may be adopted in which the output voltage V0 is greater when a greater amount of light is received by the light-receiving unit 59 and in which the output voltage V0 is smaller when a lesser amount of light is received. In such a case, using the output voltage VL of the light-receiving unit 59 as a reference surface voltage, the ratio VL/VL0 is employed either to find the correction amount dx that corresponds to the ratio VL/VL0 or to calculate a resistance value whereby VL/VL0 would=1.

Each of the functional units inside the control unit 50 (computer) in FIG. 3 is achieved primarily with software by a CPU that executes programs, but, for example, each of the functional units may also be achieved with hardware by an integrated circuit, or may be achieved by cooperation between software and hardware.

The liquid ejecting apparatus is not limited to being a printer, but rather may also be a multifunction peripheral provided with a plurality of functions in addition to a printer function, such as a scanner function and a copy function.

The printer (print apparatus) is not limited to being a serial printer, and may instead be a lateral printer, a line printer, or a page printer. In the case of, for example, a line printer, the carriage that moves the optical sensor is smaller in scale and is provided with a light-emitting unit or a light-receiving unit, and the liquid ejecting head is fundamentally fixed, though some movement to adjust the position of fixation is possible. In other words, the liquid ejecting head is not provided to the carriage, and the optical sensor is provided to the carriage. In such a case of a line printer, too, the edge detection position can be corrected with a proper correction amount in the first embodiment, and the optical sensor can be adjusted to a proper sensitivity to simply detect the edge position in the second embodiment.

The medium is not limited to being a sheet of paper, but rather may also be a resin film, a metal foil, a metal film, a composite film of resin and metal (a laminate film), a textile, a non-woven fabric, a ceramic sheet, or the like. Further, the shape of the medium is not limited to being a sheet, but rather may also be a three-dimensional shape.

In the embodiments described above, the present invention was embodied in an inkjet printer, which is one type of liquid ejecting apparatus, but there is no limitation to printers in cases where the present invention is applied to a liquid ejecting apparatus. For example, the present invention can also be embodied in a liquid ejecting apparatus for ejecting or discharging a different liquid other than ink (including a fluid body such as a liquid body or gel that is formed by dispersing or mixing particles of a functional material into a liquid). For example, the present invention may be a liquid ejecting apparatus for ejecting a liquid body that includes, in a dispersed or dissolved form, a material such as a colorant (a pixel material) or an electrode material used, inter alia, to produce liquid crystal displays, electroluminescence (EL) displays, or surface emitting displays. The present invention may further be a liquid ejecting apparatus for ejecting bio-organic matter used in the production of biochips, or a liquid ejecting apparatus for ejecting a liquid serving as a test sample, used as a precision pipette. Furthermore, the present invention may be: a liquid ejecting apparatus for ejecting onto a substrate a translucent resin solution, such as a thermosetting resin, for forming, inter alia, a hemispherical micro lens (optical lens) used in an optical communication element or the like; a liquid ejecting apparatus for ejecting an etching solution, such as an acid or an alkali, to etch a substrate or the like; or a fluid ejecting apparatus for ejecting a fluid such as a gel (for example, a physical gel) or the like. The present invention can be applied to any of these types of fluid ejecting apparatuses. In this manner, the medium (recording medium) may also be a substrate on which an element, wiring, or the like is to be formed by etching. The "liquid" ejected by the liquid ejecting apparatus encompasses liquids (including inorganic solvents, organic solvents, solutions, liquid resins, liquid metals (metal melts), and the like), liquid bodies, fluid bodies, and so forth.

The reference reflecting surface 76 may be positioned at a place that is covered by a medium of any desired size being conveyed. So doing makes it possible to prevent fouling of the reference reflecting surface 76, because the reference reflecting surface 76 will be less exposed.

What is claimed is:

1. A liquid ejecting apparatus, comprising:

a liquid ejecting head for ejecting a liquid toward a medium;

a light reflection optical sensor which is provided to a carriage for moving reciprocatingly in a movement direction intersecting with a conveyance direction of the medium and has a light-emitting unit and a light-receiving unit, the light-receiving unit outputting an output value that corresponds to an amount of light received;

a reflection unit that is used in order to acquire a parameter for adjusting a sensitivity of the optical sensor;

a measurement unit for acquiring a measurement value that corresponds to the amount of light received by the light-receiving unit, on the basis of a first output value of the light-receiving unit receiving reflected light formed when light irradiated from the light-emitting unit is reflected by the reflection unit;

a storage unit for storing an initial value of the measurement value;

a parameter acquisition unit for acquiring the parameter for adjusting the sensitivity, on the basis of a ratio between the measurement value acquired by the measurement unit and the initial value of the measurement value;

a sensitivity adjustment unit for adjusting the sensitivity of the optical sensor on the basis of the parameter; and an edge position detection unit for detecting an edge position of the medium by using a second output value outputted by the light-receiving unit receiving reflected light of light irradiated from the light-emitting unit of the optical sensor moving in the movement direction in a state where the medium has been conveyed to a position at which detection by the optical sensor is possible.

2. The liquid ejecting apparatus as set forth in claim 1, further comprising a determination unit for determining whether or not the parameter has gone beyond an allowable limit value corresponding to a sensitivity upper limit value, the sensitivity adjustment unit giving priority to adjusting a sensitivity of the light-receiving unit so long as the parameter has not gone beyond the allowable limit value but, when the parameter has gone beyond the allowable limit value, thereafter adjusting an amount of light emitted by the light-emitting unit.

3. The liquid ejecting apparatus as set forth in claim 1, wherein the parameter acquisition unit acquires the parameter that makes it possible to keep the ratio to a constant value.

4. The liquid ejecting apparatus as set forth in claim 1, wherein the sensitivity adjustment unit calculates a constant that makes it possible to keep the ratio at a constant value, and adjusts the second output value by multiplying the second output value by the constant.

5. A method for detecting a medium edge position in a liquid ejecting apparatus, the method comprising:

measuring a first output value of a light-receiving unit receiving reflected light formed when light irradiated from a light-emitting unit of an optical sensor is reflected by a reflection unit;

acquiring a parameter for adjusting a sensitivity, on the basis of a ratio between the first output value acquired in the measurement step and an initial value of the first output value;

adjusting the sensitivity of the optical sensor on the basis of the parameter; and detecting an edge position of the medium by using a second output value outputted by the light-receiving unit receiving reflected light of light irradiated from the light-emitting unit of the optical sensor moving in a movement direction intersecting with a conveyance direction of the medium, in a state where the medium has been conveyed to a position at which detection by the optical sensor is possible.

* * * * *